US010870215B2

(12) United States Patent
Shimizu et al.

(10) Patent No.: US 10,870,215 B2
(45) Date of Patent: Dec. 22, 2020

(54) STAPLE CARTRIDGE AND STAPLER

(71) Applicant: MAX CO., LTD., Tokyo (JP)

(72) Inventors: Toshio Shimizu, Tokyo (JP); Futoshi Kameda, Tokyo (JP); Takushi Shindo, Tokyo (JP)

(73) Assignee: MAX CO., LTD., Tokyo (JP)

( * ) Notice: Subject to any disclaimer, the term of this patent is extended or adjusted under 35 U.S.C. 154(b) by 116 days.

(21) Appl. No.: 16/185,204

(22) Filed: Nov. 9, 2018

(65) Prior Publication Data

US 2019/0143556 A1 May 16, 2019

(30) Foreign Application Priority Data

Nov. 10, 2017 (JP) ..... 2017-217196

(51) Int. Cl.
*B27F 7/38* (2006.01)
*B25C 5/16* (2006.01)
*B27F 7/19* (2006.01)

(52) U.S. Cl.
CPC ..... *B27F 7/38* (2013.01); *B25C 5/1689* (2013.01); *B27F 7/19* (2013.01)

(58) Field of Classification Search
CPC ..... B25C 5/1689; B27F 7/38
USPC ..... 227/120, 8, 156
See application file for complete search history.

(56) References Cited

U.S. PATENT DOCUMENTS

| | | | | |
|---|---|---|---|---|
| 2004/0200875 | A1 | 10/2004 | Haramiishi | |
| 2006/0054654 | A1* | 3/2006 | Haramiishi | B27F 7/38 227/131 |
| 2006/0144890 | A1* | 7/2006 | Haramiishi | B27F 7/38 227/120 |
| 2013/0140205 | A1 | 6/2013 | Edvardsson | |

FOREIGN PATENT DOCUMENTS

| | | | |
|---|---|---|---|
| EP | 1 598 149 | A1 | 11/2005 |
| JP | 2003-53679 | A | 2/2003 |
| JP | 2013-086284 | A | 5/2013 |
| JP | 2013-523501 | A | 6/2013 |

OTHER PUBLICATIONS

European Search Report issued in Application No. 18205081.5, dated Apr. 10, 2019, 9 pages.

* cited by examiner

*Primary Examiner* — Nathaniel C Chukwurah

(74) *Attorney, Agent, or Firm* — Rothwell, Figg, Ernst & Manbeck P.C.

(57) ABSTRACT

There is provided a staple cartridge, on which a refill is configured to be mounted, the refill including a refill main body configured to accommodate therein a plurality of staple sheets in a stacked state and having a discharging port for discharging the staple sheets, and a staple presser configured to be placed on the stacked staple sheets so as to move in a stacking direction of the staple sheets as the staple sheets are discharged through the discharging port and an amount of the staple sheets is reduced. The staple cartridge includes a mount portion, on which the refill is configured be removably mounted, and a displacement member provided on the mount portion and configured to abut against the staple presser to be displaced in accordance with a position of the staple presser in a state where the refill is mounted on the mount portion.

12 Claims, 14 Drawing Sheets

STAPLE CARTRIDGE AND STAPLER

CROSS-REFERENCE TO RELATED APPLICATION

This application claims priority from Japanese Patent Application No. 2017-217196 filed on Nov. 10, 2017, the entire contents of which are incorporated herein by reference.

TECHNICAL FIELD

Aspects of the present invention relate to a staple cartridge for accommodating therein staples for binding sheets of paper and also to a stapler for binding sheets of paper with staples.

BACKGROUND ART

An electric stapler mounted on a post-processing device has a refill for accommodating therein staple sheets, each of which is formed by connecting a plurality of staples in a sheet shape, and a cartridge on which the refill is mounted. The refill is replaceable, and thus when staples in the refill are fully consumed, the refill is replaced with another new refill.

Incidentally, an electric stapler is known which can detect that staples in a refill are fully consumed. For example, an electric stapler described in JP-A-2003-53679 has an opening formed at a bottom of a refill main body for accommodating staples, so that if staples are fully consumed, a leg portion (convex portion) of a placing plate for covering staples can be fitted into the opening. Then, if it is detected that the placing plate is fitted into the opening and is further lowered, it is determined that staples are fully consumed.

Also, there is proposed a technique, in which a wireless tag referred to as RFID is attached to a refill such that a remaining amount of staples or staple sheets can be detected (e.g., see JP-A-2013-523501).

For example, when bookbinding operation is performed using an electric stapler, it is necessary to bind a large amount of bundles of sheets of paper. Accordingly, a huge number of times of stapling processes has to be consecutively performed. Therefore, even if consumption of staples can be grasped as in the technique described in JP-A-2003-53679, there is a possibility that when that fact is grasped, staples have already been fully consumed and thus the bookbinding operation is suddenly stopped. Thus, in order to prevent such a situation, it is advantageous to grasp a remaining amount of staples, rather than empty of staples.

In the technique described in JP-A-2013-523501 using the RFID, it is possible to detect a remaining amount of staples. However, the RFID has to be attached on every refill, which causes the work to be complicated and also the cost to be increased. The stapler has to have a communication function with the RFID, which causes the stapler itself to be more expensive. In addition, information is communicated via electric signals, which are susceptible to electrical noise.

SUMMARY

Accordingly, an aspect of the present invention provides a staple cartridge which can detect a remaining amount (number) of staple sheets in a mechanical manner, and also a stapler using the staple cartridge.

According to an embodiment of the present invention, there is provided a staple cartridge, on which a refill is configured to be mounted, the refill including: a refill main body configured to accommodate therein a plurality of staple sheets in a stacked state and having a discharging port for discharging the staple sheets; and a staple presser configured to be placed on the stacked staple sheets so as to move in a stacking direction of the staple sheets as the staple sheets are discharged through the discharging port and an amount of the staple sheets is reduced. The staple cartridge include a mount portion, on which the refill is configured be removably mounted, and a displacement member provided on the mount portion and configured to abut against the staple presser to be displaced in accordance with a position of the staple presser in a state where the refill is mounted on the mount portion.

According to the above configuration, the staple cartridge includes the displacement member configured to abut against the staple presser placed on the staple sheets to be displaced in accordance with a position of the staple presser. As the amount of staple sheets is reduced, the staple presser moves in the stacking direction of the staple sheets. Therefore, a remaining amount of staple sheets can be grasped by checking displacement of the displacement member.

According to the above configuration, a remaining amount of staple sheets accommodated in the refill based on displacement of the displacement member. Since the displacement member is configured to be displaced in a mechanical manner, no communication function and the like as in the case of using the RFID is necessary.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Hereinafter, a staple cartridge and a stapler according to embodiments of the present invention will be described with reference to the accompanying drawings.

<Exemplary Configuration of Cartridge of the Present Embodiment>

Figure 1:
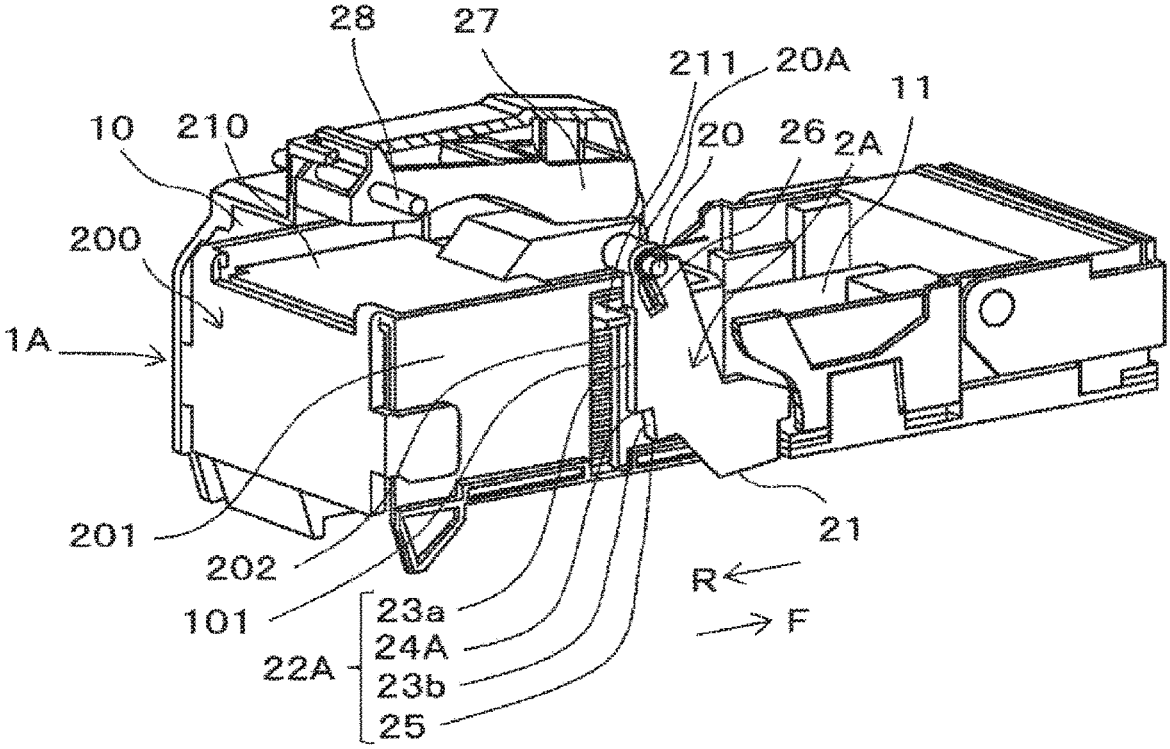
FIG. 1 is a broken perspective view showing an example of a cartridge according to a present embodiment.
Figure 2:
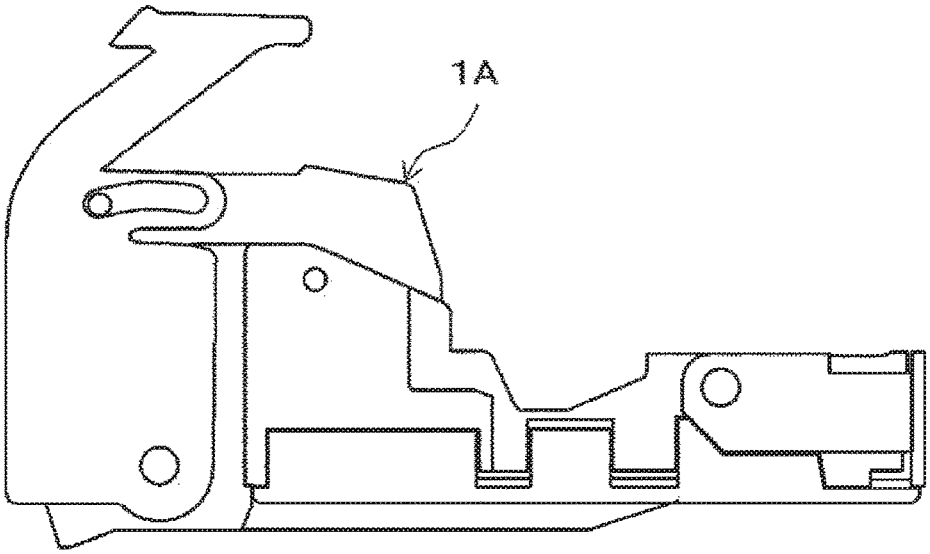
FIG. 2 is a side view showing the example of the cartridge according to the present embodiment.
Figure 3A:
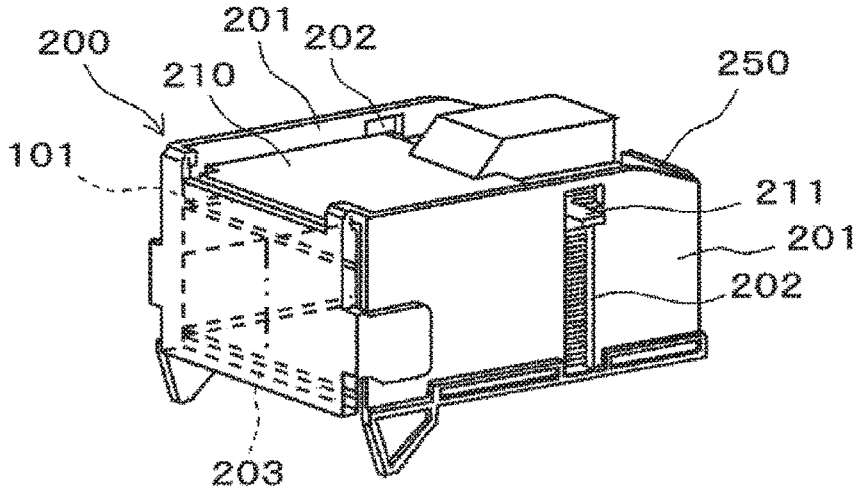
FIGS. 3A and 3B are perspective views showing an example of a refill to be mounted on the cartridge according to the present embodiment.
Figure 3B:
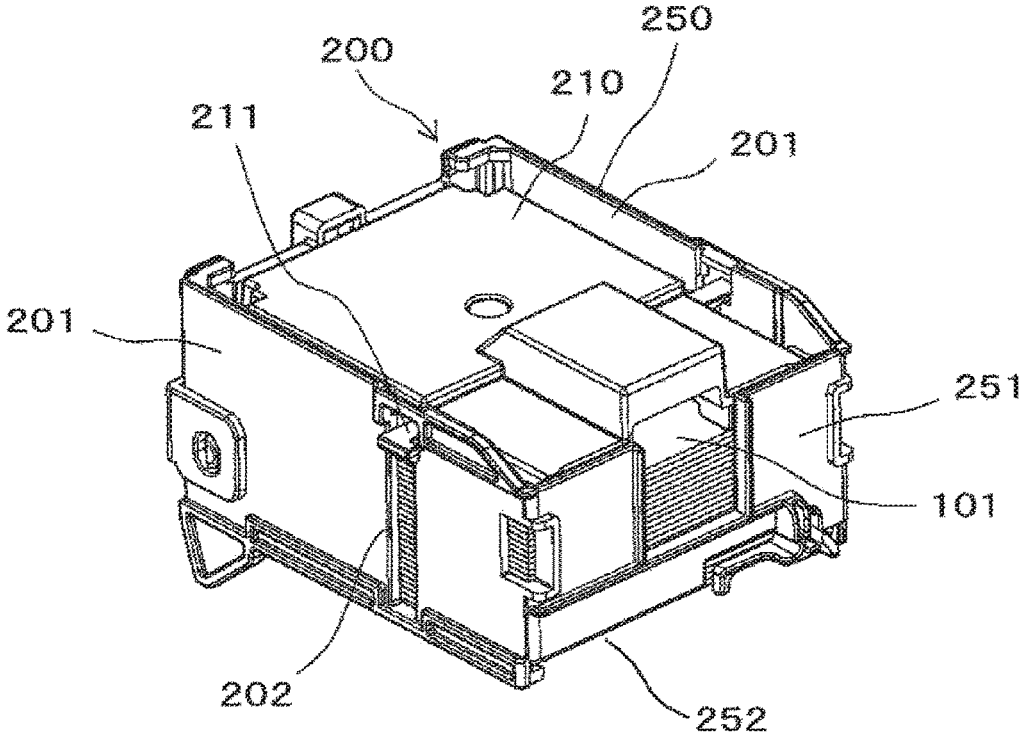

FIG. 1 is a broken perspective view showing an example of a cartridge according to the present embodiment, and FIG. 2 is a side view showing the example of the cartridge according to the present embodiment. FIGS. 3A and 3B are perspective views showing an example of a refill to be mounted on the cartridge according to the present embodiment.

First, a cartridge 1A according to the present embodiment will be described. The cartridge 1A of the present embodiment is an example of a staple cartridge and on which a refill 200 which accommodates staple sheets 101 therein is configured to be mounted. The cartridge 1A includes an actuator 2A configured to operate in accordance with an amount (number) of staple sheets 101 accommodated in the refill 200 and thus is configured to output the amount of staple sheets 101 in the refill 200 based on a position of the actuator 2A.

Next, the staple sheet 101 to be accommodated in the refill 200 will be described. The staple sheet 101 is formed by bonding a plurality of linear staples in a sheet shape.

Next, the refill 200 will be described. The refill 200 includes a refill main body 250 which is configured to accommodate a plurality of staple sheets 101 in a stacked state. The refill 200 is configured such that the refill main body 250 has a rectangular parallelepiped space capable of accommodating the staple sheets 101 therein, and the space is defined by a bottom surface, on which the staple sheets 101 are placed, and four side surfaces, which stand from the bottom surface. The refill 200 is opened at a top surface side thereof opposite to the bottom surface of the refill main body 250.

The refill 200 has opening portions 202 on lateral side portions 201 constituting two opposite side surfaces of the four side surfaces of the refill main body 250. The opening portions 202 are an example of a receiving portion and extend through the lateral side portions 201 of the refill 200. The opening portions 202 extend in a direction from the bottom surface of the refill 200 toward the top surface, i.e., in a stacking direction of the staple sheets 101. The refill 200 has a discharging port 252 for discharging the staple sheets 101, arranged on a lower side of a front side portion 251 of the refill main body 250, which is one of two side surfaces of the four side surfaces thereof other than the lateral side portions 201.

The refill 200 includes a staple presser 210 for pressing the staple sheets 101. The staple presser 210 is placed on the staple sheets 101 and is configured to move in the stacking direction of the staple sheets 101 as the staple sheets 101 are discharged through the discharging port 252 and the amount thereof is reduced. That is, the staple presser 210 is changed in height in the stacking direction in accordance with the amount of the stacked staple sheets 101. In this manner, the staple sheets 101 are accommodated in the refill 200 to be stacked between the staple presser 210 and a bottom portion 203 which constitutes the bottom surface.

The staple presser 210 includes protrusions 211 for operating the actuator 2A of the cartridge 1A. The protrusions 211 are an example of an engaging portion and are provided to laterally protrude on lateral side portions of the staple presser 210. Each protrusion 211 enters the respective opening portion 202 of the refill 200 (i.e., the engaging portion is engaged in the receiving portion) to protrude outward from the lateral side portion 201 of the refill 200 and move along the opening portion 202 (while being guided thereby). Therefore, the staple presser 210 is moved in accordance with the amount of the staple sheets 101 accommodated in the refill 200.

Next, the details of the cartridge 1A according to the present embodiment will be described. The cartridge 1A includes a mount portion 10, on which the refill 200 is removably mounted, and a conveyance portion 11, to which the staple sheet 101 fed from the refill 200 is conveyed. The cartridge 1A is configured such that the conveyance portion 11 extends from a front side thereof which is one side of the mount portion 10, and a rear side thereof which is the other side of the mount portion 10 is opened.

The cartridge 1A includes the actuator 2A on one inner surface of the mount portion 10. The actuator 2A, which is an example of a displacement member, is provided at a location opposing the protrusion 211 of the refill 200 in a state where the refill 200 is mounted on the mount portion 10 of the cartridge 1A.

The actuator 2A is a plate-shaped member extending in the stacking direction of the staple sheets 101 and includes a support portion 20A provided on a base end side thereof and supported on the cartridge 1A to be rotatable about a shaft 20, and an acting portion 21 provided on the other end side thereof.

The actuator 2A includes an abutting portion 22A arranged between the support portion 20A and the acting portion 21 and configured to abut against the protrusion 211 of the refill 200. The abutting portion 22A is configured by a surface, against which the protrusion 211 abuts, and generally extends from the support portion 20A along the stacking direction. The abutting portion 22A includes a concave portion on a part thereof and includes a first pressed portion 23*a* and a second pressed portion 23*b* in this order from a side closer to the shaft 20. Specifically, the abutting portion 22A includes a portion formed in a crank shape and is constituted of the first pressed portion 23*a* extending from the shaft 20 in the stacking direction; a first operation portion 24A bent from the first pressed portion 23*a* to extend in a direction generally perpendicular to the stacking direction and away from the protrusion 211; and the second pressed portion 23*b* bent from the first operation portion 24A to again extend in the stacking direction. That is, the abutting portion 22A is formed in a crank shape to be partially recessed by the first pressed portion 23*a*, the first operation portion 24A and the second pressed portion 23*b*. A second operation portion 25 bent from the second pressed portion 23*b* to extend in a direction generally perpendicular to the stacking direction and away from the protrusion 211 is provided below the second pressed portion 23*b*.

The actuator 2A (abutting portion 22A) is urged in a direction toward the protrusion 211 of the refill 200 by a spring 26, which is provided in the cartridge 1A. The spring 26, which is an example of an elastic member, is configured by a torsion coil spring in the present example and is configured to rotate the actuator 2A about the shaft 20 in a direction approaching the protrusion 211.

The cartridge 1A includes a pressing member 27 for pressing the staple presser 210 of the refill 200 in the stacking direction. The pressing member 27 is urged by a spring (not shown) to be rotated about a shaft 28, so as to press the staple presser 210.

Figure 4:
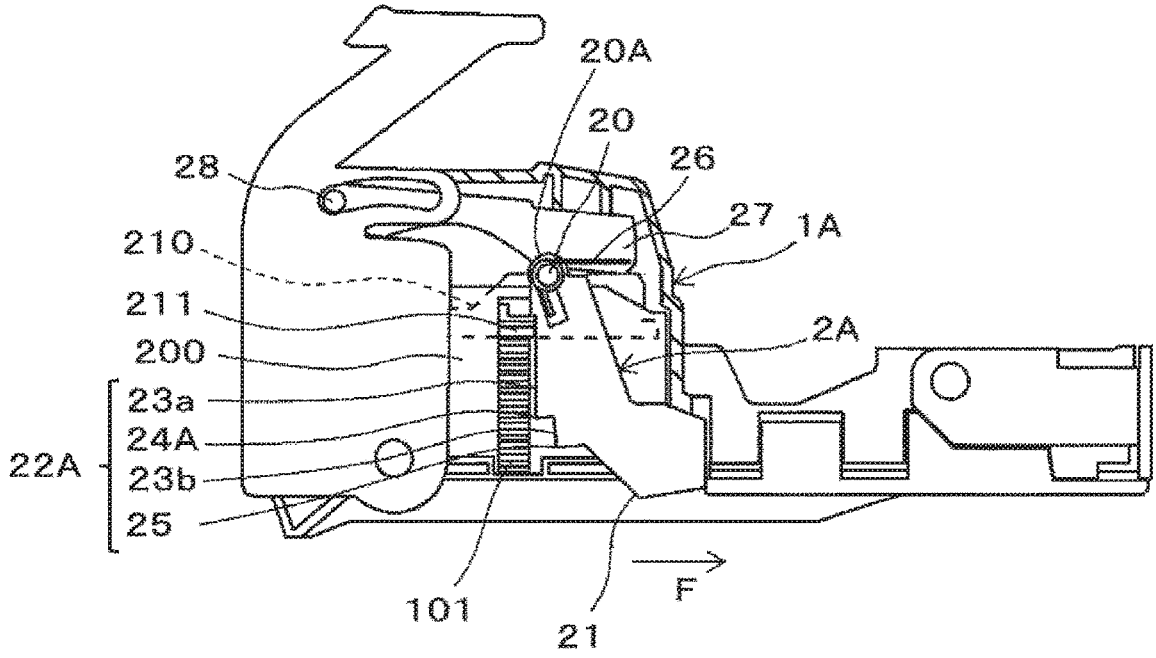
FIG. 4 is a broken side view showing an example of operation of an actuator in accordance with an amount of staple sheets.
Figure 5:
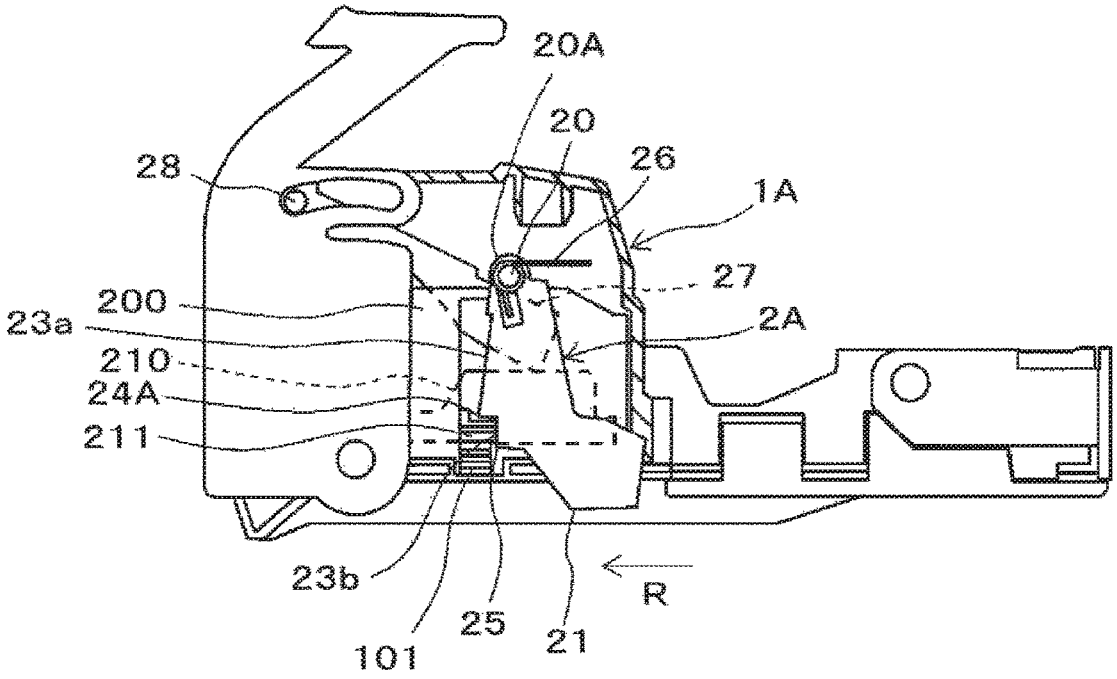
FIG. 5 is a broken side view showing an example of operation of the actuator in accordance with the amount of staple sheets.
Figure 6:
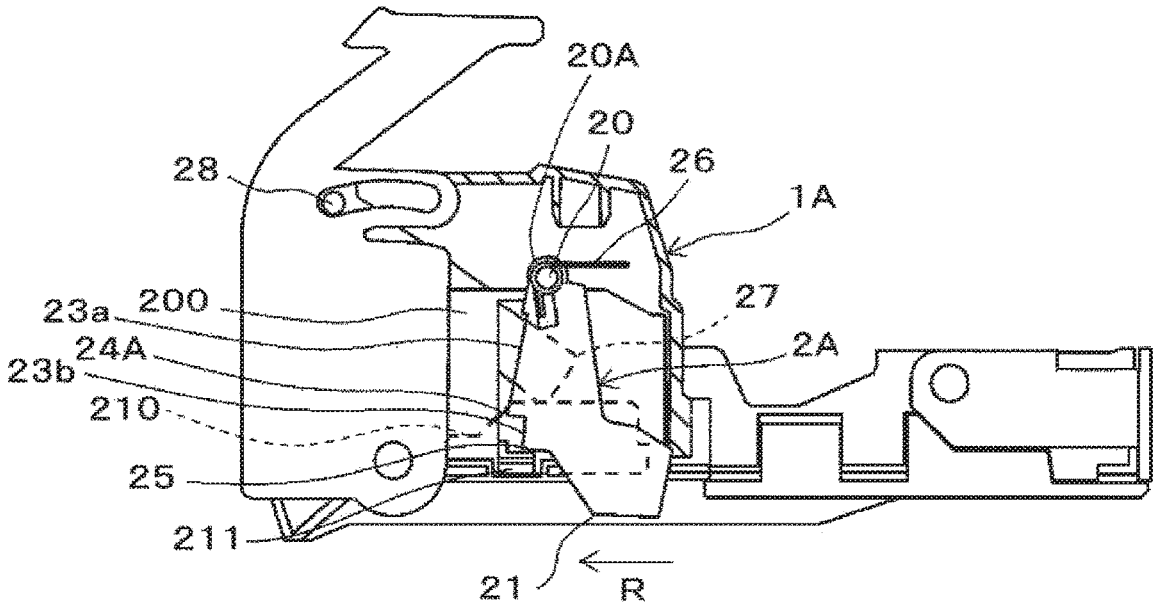
FIG. 6 is a broken side view showing an example of operation of the actuator in accordance with the amount of staple sheets.

FIGS. 4 to 6 are broken side views showing an example of operation of the actuator in accordance with the amount of the staple sheets. If the refill 200 is mounted on the cartridge 1A, the protrusion 211 of the staple presser 210 presses the abutting portion 22A of the actuator 2A in a direction as shown by an arrow F in FIG. 4. The actuator 2A is urged by the spring 26 in a direction toward the protrusion 211, so that the protrusion 211 and the abutting portion 22A abut against each other.

If the refill 200 is mounted on the cartridge 1A, the pressing member 27 of the cartridge 1A presses the staple presser 210 of the refill 200. Therefore, if the amount of the staple sheets 101 accommodated in the refill 200 is reduced, the staple presser 210 moves correspondingly and hence the protrusion 211 of the staple presser 210 moves as well.

Accordingly, if the amount of staple sheets 101 accommodated in the refill 200 is changed (reduced) and hence the staple presser 210 moves, the protrusion 211 of the staple presser 210 abutting against the abutting portion 22A moves as well, so as to cause a position, at which the protrusion 211 and the abutting portion 22A abuts against each other, to be changed.

As shown in FIG. 4, a shape of the abutting portion 22A is set such that at a position of the staple presser 210 when the maximum amount of the staple sheets 101 is accommodated in the refill 200, the protrusion 211 abuts against the first pressed portion 23*a*.

The shape of the abutting portion 22A is set such that at a position of the staple presser 210 when the amount of the staple sheets 101 accommodated in the refill 200 is equal to or smaller than the maximum amount and larger than a first predetermined amount, the protrusion 211 abuts against the first pressed portion 23*a*.

Further, as shown in FIG. 5, the shape of the abutting portion 22A is set such that at a position of the staple presser 210 when the amount of the staple sheets 101 accommodated in the refill 200 becomes the first predetermined amount, the protrusion 211 passes over the first operation portion 24A and then abuts against the second pressed portion 23*b*. Meanwhile, the state where the amount of the staple sheets 101 accommodated in the refill 200 has become the first predetermined amount is referred to as a near end.

The shape of the abutting portion 22A is set such that at a position of the staple presser 210 when the amount of the staple sheets 101 accommodated in the refill 200 is equal to or smaller than the first predetermined amount and larger than a second predetermined amount, the protrusion 211 abuts against the second pressed portion 23*b*.

Further, as shown in FIG. 6, the shape of the abutting portion 22A is set such that at a position of the staple presser 210 when the amount of the staple sheets 101 accommodated in the refill 200 becomes the second predetermined amount, the protrusion 211 passes over the second operation portion 25. Meanwhile, the state where the amount of the staple sheets 101 accommodated in the refill 200 has become the second predetermined amount is referred to as an end. In the present example, the second predetermined amount is 0 and thus a state where all the staple sheets 101 have been fed from the refill 200.

In this manner, the protrusion 211 moves along the first pressed portion 23*a* during a period of time from when the amount of the staple sheets 101 accommodated in the refill 200 is the maximum amount to when the amount thereof becomes the first predetermined amount. Therefore, the actuator 2A is not displaced. However, if the amount of the staple sheets 101 becomes the first predetermined amount, the protrusion 211 passes over the first operation portion 24A and then abuts against the second pressed portion 23*b*. As a result, the actuator 2A is rotated to a first output position in a direction of an arrow R by a force of the swing 26. If the amount of the staple sheets 101 is reduced and thus becomes the second predetermined amount, the protrusion 211 passes over the second operation portion 25. As a result, the actuator 2A is further rotated to a second output position. Therefore, it is possible to detect a remaining amount of the staple sheets 101, i.e., the near end and the end in the present embodiment, by monitoring a position (output position) of the actuator 2A. In other words, whether the staple sheets 101 accommodated in the refill 200 is in the near end state or the end state can be outputted as a position of the acting portion 21 by movement of the actuator 2A.

<Exemplary Configuration of Stapler of the Present Embodiment>

Figure 7:
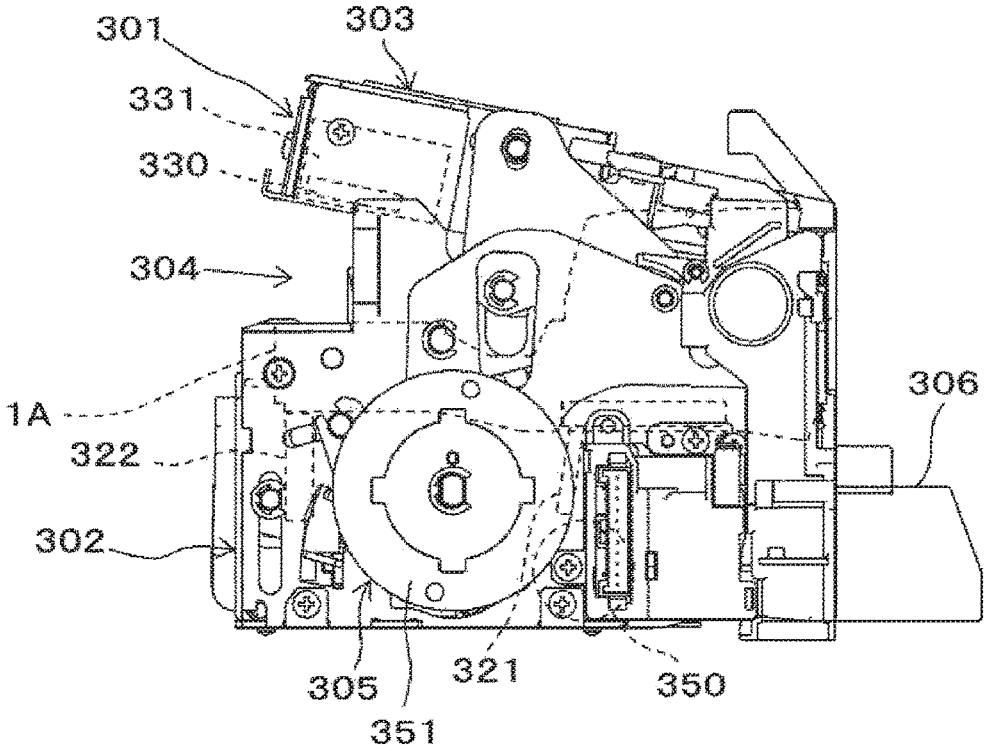
FIG. 7 is a side view showing an example of a stapler according to the present embodiment.
Figure 8:
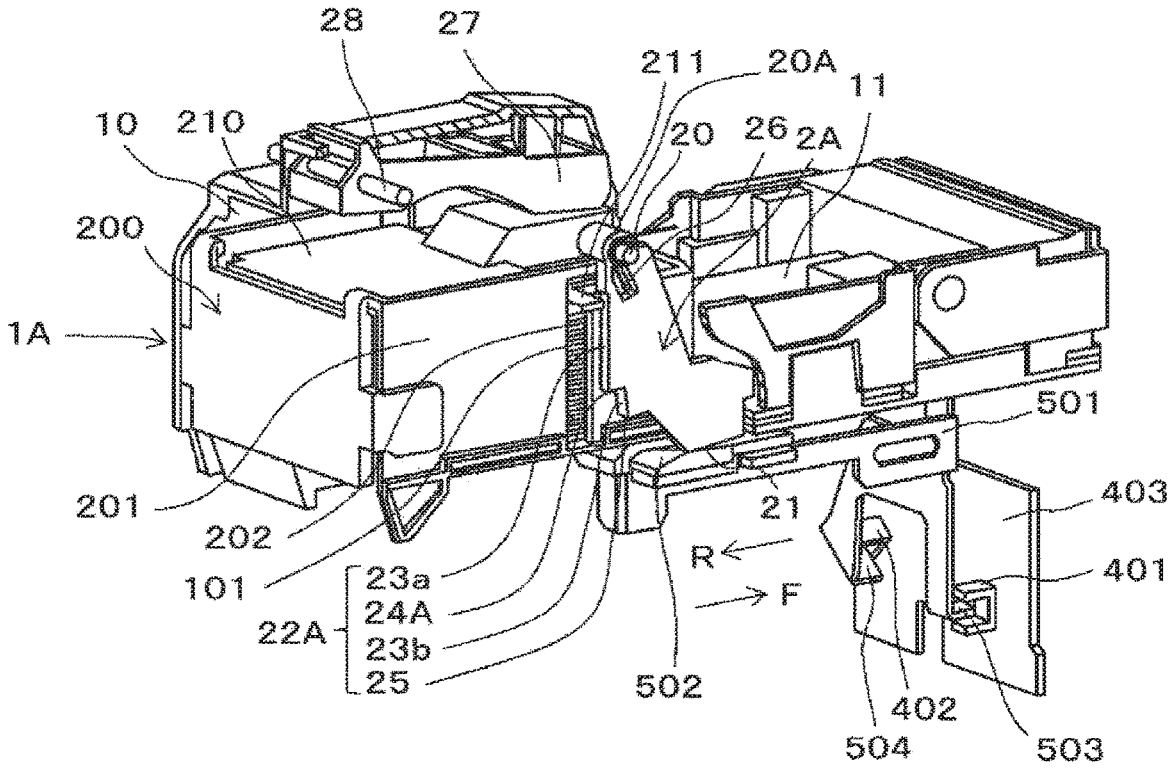
FIG. 8 is a perspective view showing the example of the stapler according to the present embodiment.
Figure 9:
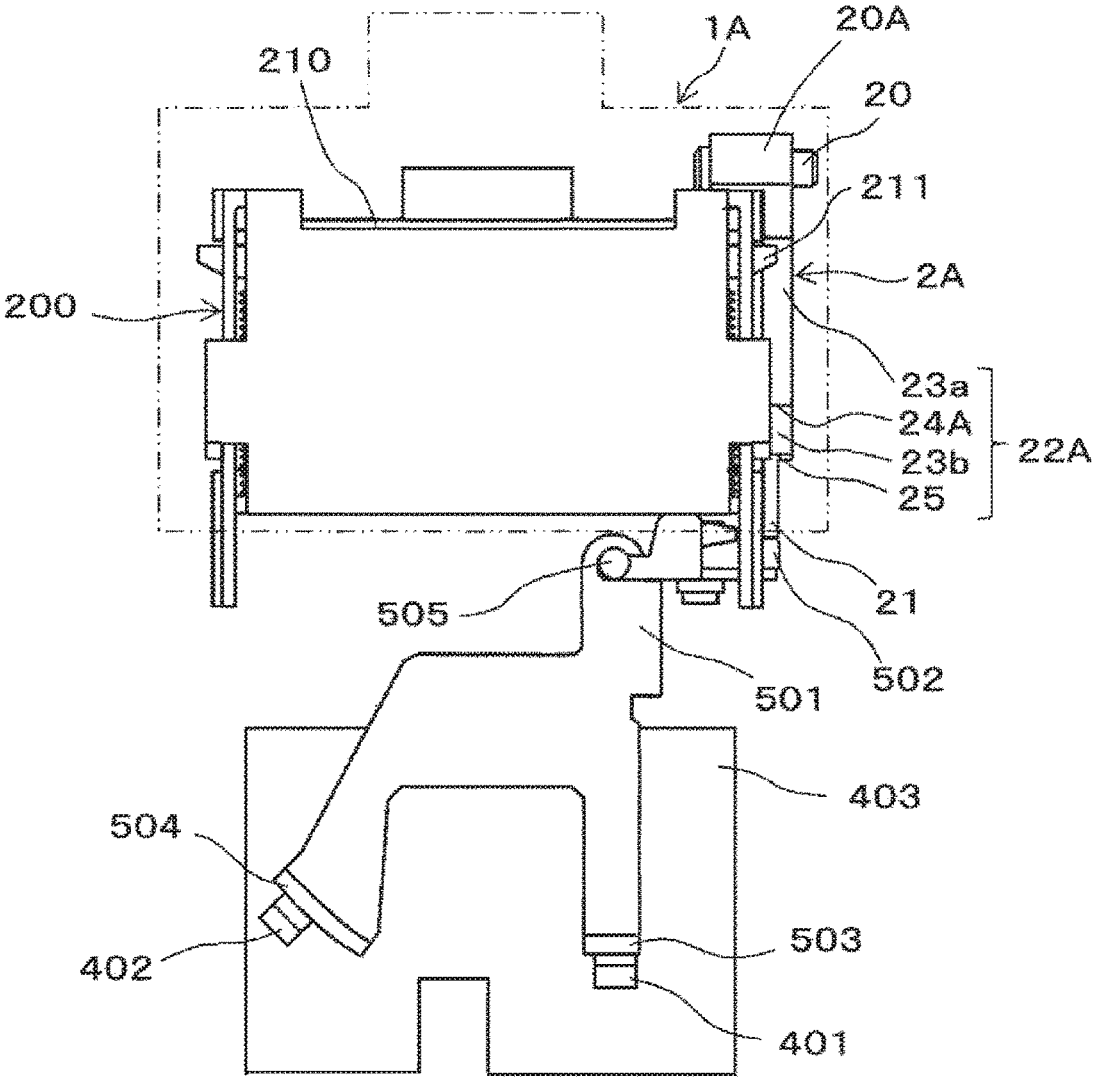
FIG. 9 is a rear view showing the example of the stapler according to the present embodiment.

FIG. 7 is a side view showing an example of a stapler according to the present embodiment, FIG. 8 is a perspective view showing the example of the stapler according to the present embodiment, and FIG. 9 is a rear view showing the example of the stapler according to the present embodiment. FIGS. 10A to 10D are explanatory views showing an example of operation of binding sheets of paper P with the stapler.

First, operation of binding sheets of paper P with a stapler 100 will be described with reference to FIGS. 10A to 10D. One staple 100 is separated from a staple sheet 101 fed from the refill 200 as described above, and then as shown in FIG. 10A, both ends of the staple 100 having a linear shape are bent in one direction, so as to form leg portions 103 on both ends of a crown portion 102.

Figure 10A:
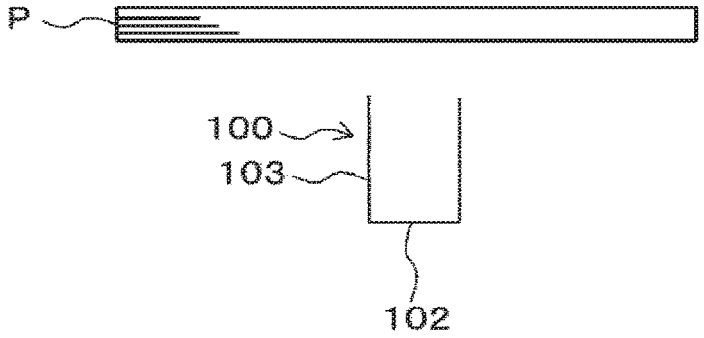
FIGS. 10A to 10D are explanatory views showing an example of operation of binding sheets of paper with the stapler.
Figure 10B:
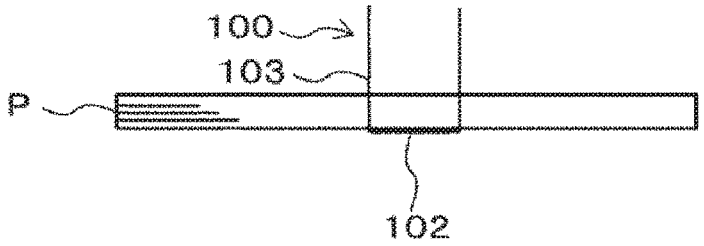
Figure 10C:
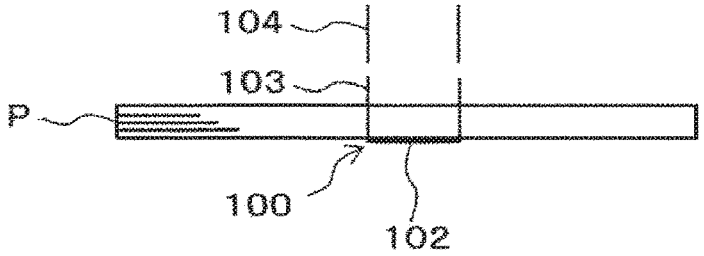
Figure 10D:
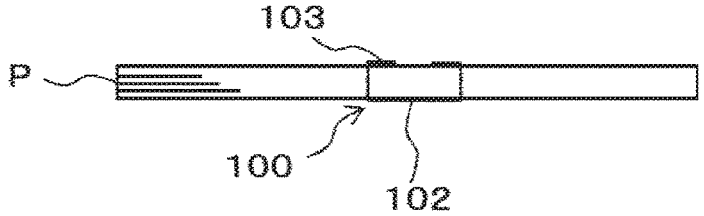

The staple 100 is configured such that as shown in FIG. 10B, the leg portions 103 penetrate sheets of paper P up to a position, at which the crown portion 102 comes in contact with the sheets of paper P, and then as shown in FIG. 10C, surplus parts of the leg portions 103, which have penetrated the sheets of paper, are cut as cut staples 104. In the staple 100 of which the leg portions 103 have been cut into a predetermined length, as shown in FIG. 10D, the leg portions 103, which have penetrated the sheets of paper P, are bent and thus the sheets of paper P are bound with the staple 100.

Next, a configuration of the stapler 301 of the present embodiment will be described with reference to the drawings. The stapler 301 includes a striking mechanism unit 302 for supplying staple sheet 101 and then striking a staple 100, and a binding mechanism unit 303 for binding sheets of paper P with the staple 100 by cutting leg portions 103 of the staple 100 and then bending the leg portions 103 in cooperation with the striking mechanism unit 302. The stapler 301 includes a sheet sandwiching unit 304 formed for sandwiching a bundle of sheets of paper P between the striking mechanism unit 302 and the binding mechanism unit 303.

In the following description, a side on which the paper sandwiching unit 304 is provided is referred to as a front side of the stapler 301, and a side opposite to the side on which the paper sandwiching unit 304 is provided is referred to as a rear side thereof. A side on which the binding mechanism unit 303 is provided is referred to as an upper side of the stapler 301, and a side on which the striking mechanism unit 302 is provided is referred to as a lower side of the stapler 301.

The striking mechanism unit 302 is configured such that the cartridge 1A is removably attached thereon. The striking mechanism unit 302 includes a feeding portion 321 for feeding a staple sheet 101 from the cartridge 1A and a striking portion 322 for shaping a staple 100 separated from the staple sheet 101 and then driving the staple 100 into sheets of paper P.

The binding mechanism unit 303 includes a cutting portion 330 for cutting leg portions 103 of the staple 100, which have penetrated the sheets of paper P, into a predetermined length, and a clincher portion 331 for bending the leg portions 103 of the staple 100, which have penetrated the sheets of paper P and have been cut into the predetermined length, toward the sheets of paper P.

The stapler 301 includes a drive unit 305 for operating the striking mechanism unit 302 and the binding mechanism unit 303 to approach or separate from each other and also for driving the feeding portion 321 and the striking portion 322 of the striking mechanism unit 302 and the cutting portion 330 and the clincher portion 331 of the binding mechanism unit 303.

The drive unit 305 includes a cam 351 driven by a motor 350 provided in the striking mechanism unit 302, linkages (not shown) for transferring operation of the cam 351 to each part, and the like.

The striking mechanism unit 302 and the binding mechanism unit 303 are moved relative to each other in directions approaching and separating from each other, as operation of the cam 351 is transferred to the binding mechanism unit 303 via linkages and the like.

According to the stapler 301, as the cam 351 is rotationally operated in one direction, the binding mechanism unit 303 is moved in a direction approaching the striking mechanism unit 302, and thus the sheets of paper P are sandwiched by the paper sandwiching unit 304 at a predetermined timing. According to the stapler 301, as the cam 351 is further rotationally operated in one direction, the binding mechanism unit 303 is moved in a direction separating from the striking mechanism unit 302 at a predetermined timing, and thus sandwiching of the sheets of paper P by the paper sandwiching unit 304 is released.

Further, according to the stapler 301, the operation of the cam 351 is transferred to the feeding portion 321 and the striking portion 322 via linkages and the like. Accordingly, as the cam 351 is rotationally operated in one direction, a staple sheet 101 accommodated in the cartridge 1A is fed by the feeding portion 321. Further, according to the stapler 301, the striking portion 322 drives a shaped staple 100 of the staple sheet 101, which is located at the most leading end thereof, into the sheets of paper P, which are sandwiched by the paper sandwiching portion 304, so as to cause leg portions 103 of the staple 100 to penetrate the sheets of paper P. In addition, a second staple 100 is shaped.

According to the stapler 301, the operation of the cam 351 is transferred to the cutting portion 330 and the clincher portion 331 via linkages and the like. Accordingly, as the cam 351 is rotationally operated in one direction, the leg portions 103 of the staple 100, which have penetrated the sheets of paper P, are cut into a predetermined length by the cutting portion 330, and then the leg portions 103 of the staple 100, which have been cut into the predetermined length, are bent by the clincher portion 331.

The stapler 301 includes a cut staple receiving portion 306 for receiving cut staples 104 cut by the cutting portion 330. The cut staple receiving portion 306 is removably attached on the stapler 301 on a rear side of the stapler 301 opposite to a side thereof, on which the paper sandwiching portion 304 is provided.

Next, a configuration for detecting the amount of staple sheets 101 accommodated in the refill 200 by the stapler 301 will be described.

As shown in FIG. 8, the stapler 301 includes a near end sensor 401 for detecting that the amount of staple sheets 101 accommodated in the refill 200 becomes the first predetermined amount i.e. a state, which is referred to as the near end, and an end sensor 402 for detecting that the amount of staple sheets 101 accommodated in the refill 200 becomes the second predetermined amount i.e. a state, which is referred to as the end.

The near end sensor 401 and the end sensor 402, which are an example of a detection unit, are configured by an optical sensor having a light receiving element and a light emitting element (not shown), so that an output thereof is changed depending on whether an optical path therebetween is blocked. The near end sensor 401 and the end sensor 402 are mounted on a board 403 together with other sensors and the like (not shown).

The stapler 301 includes a transfer member 501 for transferring operation of the actuator 2A of the cartridge 1A to the near end sensor 401 and the end sensor 402.

The transfer member 501 includes an acted portion 502 configured to be engaged with the acting portion 21 of the actuator 2A and thus to be pushed by the acting portion 21 due to movement of the actuator 2A, a first detected portion 503 configured to be detected by the near end sensor 401 and a second detected portion 504 configured to be detected by the end sensor 402. As the acted portion 502 is pushed by the acting portion 21 due to movement of the actuator 2A, the transfer member 501 is rotated about a shaft 505 shown in FIG. 9, so that the first detected portion 503 and the second detected portion 504 are moved.

A path, along which the first detected portion 503 is moved by rotation of the transfer member 501 about the shaft 505, crosses an optical path of the near end sensor 401. A path, along which the second detected portion 504 is moved by rotation of the transfer member 501 about the shaft 505, crosses an optical path of the end sensor 402.

<Exemplary Configuration of Stapler and Cartridge of the Present Embodiment>

Figure 11:
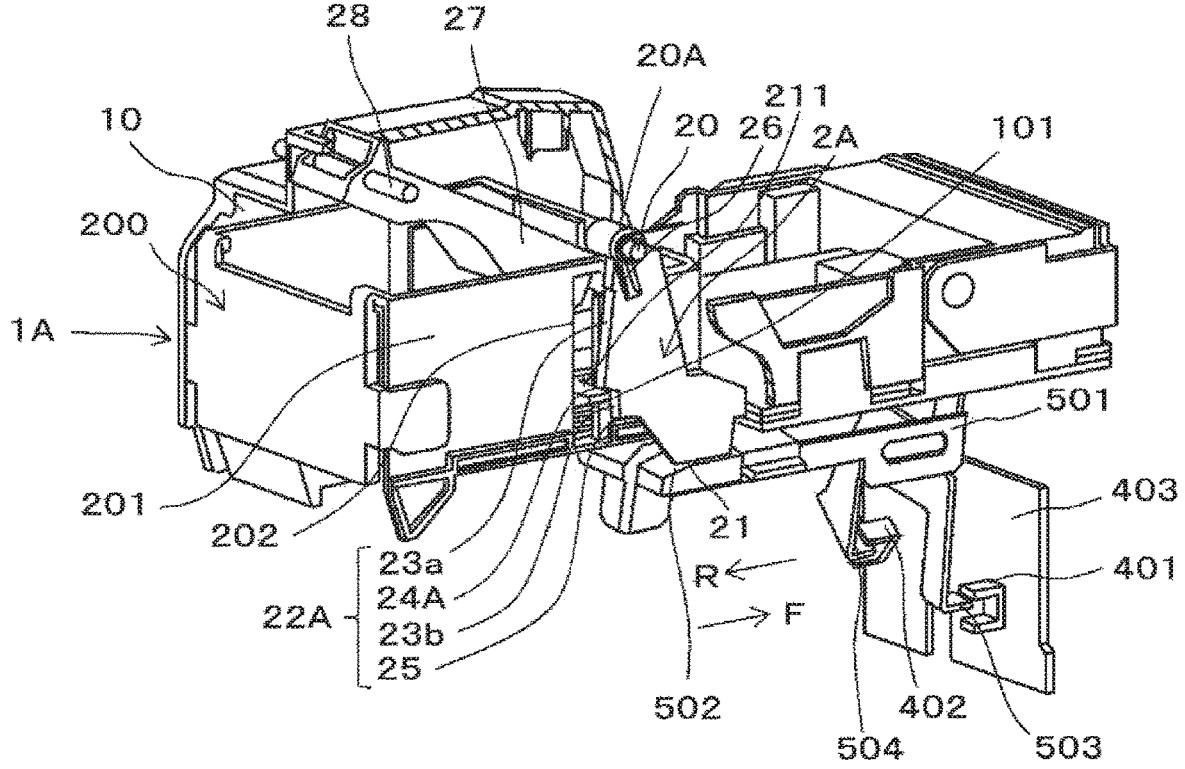
FIG. 11 is a perspective view showing an example of operation of the cartridge and the stapler according to the present embodiment.
Figure 12:
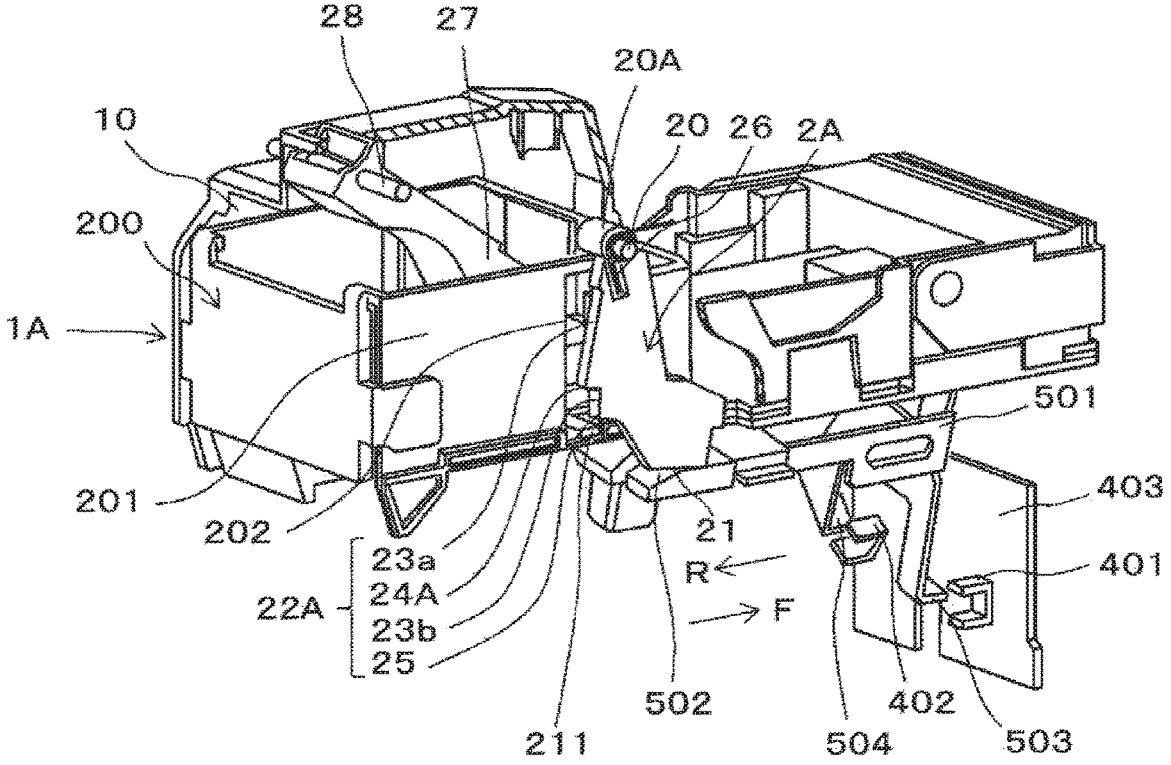
FIG. 12 is a perspective view showing an example of operation of the cartridge and the stapler according to the present embodiment.
Figure 13:
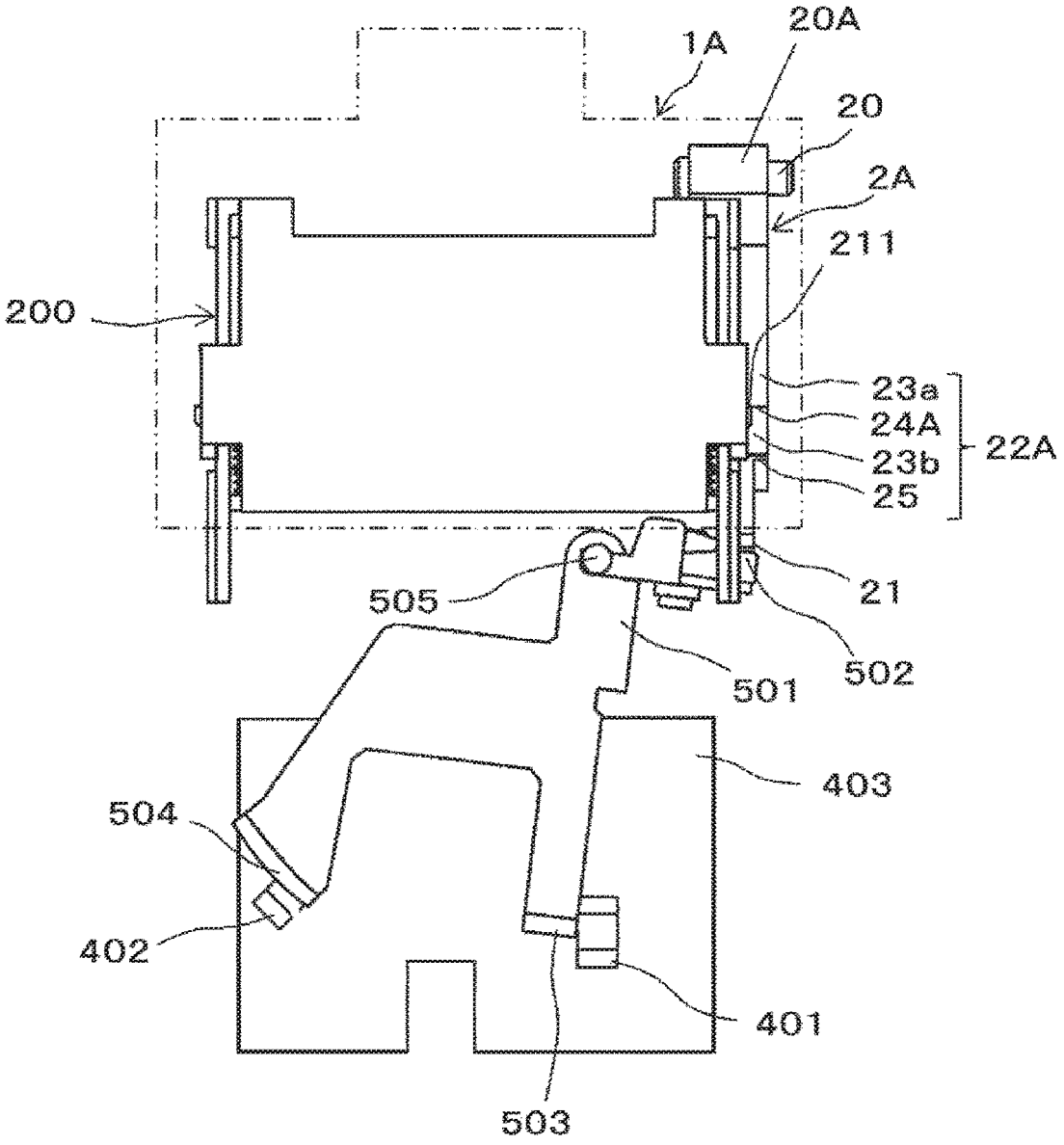
FIG. 13 is a rear view showing an example of operation of the cartridge and the stapler according to the present embodiment.
Figure 14:
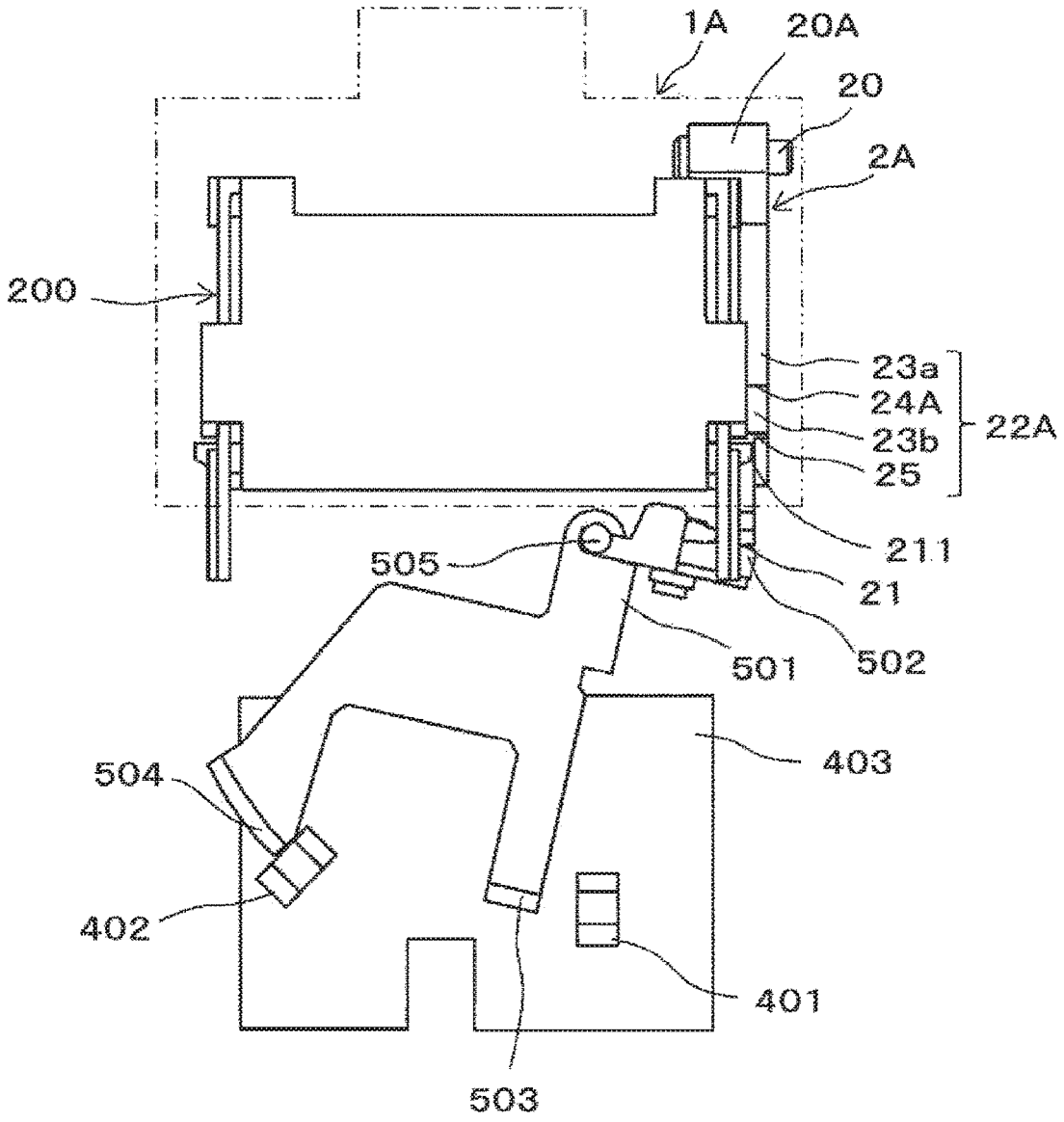
FIG. 14 is a rear view showing an example of operation of the cartridge and the stapler according to the present embodiment.

FIGS. 11 and 12 are perspective views showing an example of operation of the cartridge and the stapler according to the present embodiment, and FIGS. 13 and 14 are rear views showing the example of operation of the cartridge and the stapler according to the present embodiment. Next, operation of the cartridge and the stapler of the present embodiment will be described with reference to the drawings.

If the refill 200, in which the maximum amount of the staple sheets 101 is accommodated, is mounted on the cartridge 1A, the protrusion 211 of the staple presser 210 comes in contact with the first pressed portion 23*a* of the actuator 2A as shown in FIG. 4.

If the cartridge 1A is attached on the staple 301, the acting portion 21 of the actuator 2A presses the acted portion 502 of the transfer member 501. A position of the acting portion 21 of the actuator 2A is changed depending on a position at which the protrusion 211 of the staple presser 210 and the abutting portion 22A of the actuator 2A abuts against each other, and also a position of the transfer member 501 is changed in accordance with the acting portion 21.

In a state where the maximum amount of the staple sheets 101 is accommodated in the refill 200 and, as shown in FIG. 4, the protrusion 211 of the staple presser 210 abuts against the first pressed portion 23*a* of the actuator 2A, the acting portion 21 of the actuator 2A presses the acted portion 502 of the transfer member 501 as shown in FIGS. 8 and 9, so that the first detected portion 503 is positioned in the near end sensor 401 and the second detected portion 504 is positioned in the end sensor 402.

Since the first detected portion 503 is positioned in the near end sensor 401, an optical path of light receiving/emitting elements (not shown) of the near end sensor 401 is blocked. Also, since the second detected portion 504 is positioned in the end sensor 402, an optical path of light receiving/emitting elements (not shown) of the end sensor 402 is blocked.

In the stapler 301, it is determined that the amount of the staple sheets 101 accommodated in the refill 200 is equal to or larger than the first predetermined amount, based on a combination of outputs of the sensors in the state where the first detected portion 503 is positioned in the near end sensor 401 and the second detected portion 504 is positioned in the end sensor 402.

Operation of binding sheets of paper P with the stapler 301 is performed, and thus the amount of the staple sheets 101 accommodated in the refill 200 is reduced each time when all staples 100 of one staple sheet 101 are used.

In the refill 200 accommodated in the cartridge 1A, the staple presser 210 is pressed by the pressing member 27. If the amount of the staple sheets 101 is reduced and thus the amount of the staple sheets 101 accommodated in the refill 200 becomes the first predetermined amount, the protrusion 211 of the staple presser 210 passes over the first operation portion 24A of the abutting portion 22A. If the protrusion 211 has passed over the first operation portion 24A, as shown in FIG. 5, the actuator 2A is urged by the spring 26 to be rotated in a direction of an arrow R up to the first output position, at which the second pressed portion 23*b* abuts against the protrusion 211, so as to cause the position of the acting portion 21 to be changed.

In the state where the protrusion 211 of the staple presser 210 abuts against the second pressed portion 23*b* of the actuator 2A, the acting portion 21 of the actuator 2A presses the acted portion 502 of the transfer member 501 as shown in FIGS. 11 and 13. Therefore, the first detected portion 503 passes through the near end sensor 401 and the second detected portion 504 is positioned in the end sensor 402.

Since the first detected portion 503 passes through the near end sensor 401, the optical path of light receiving/emitting elements (not shown) of the near end sensor 401 is not blocked. Also, since the second detected portion 504 is positioned in the end sensor 402, the optical path of light receiving/emitting elements (not shown) of the end sensor 402 is blocked.

In the stapler 301, it is determined that the amount of the staple sheets 101 accommodated in the refill 200 becomes the first predetermined amount i.e., the near end state, based on a combination of outputs of the sensors in the state where the first detected portion 503 has passed through the near end sensor 401 and the second detected portion 504 is positioned in the end sensor 402.

If the amount of the staple sheets 101 accommodated in the refill 200 is further reduced and thus the amount of the staple sheets 101 accommodated in the refill 200 becomes the second predetermined amount, the protrusion 211 of the staple presser 210 passes over the second operation portion 25 of the abutting portion 22A. If the protrusion 211 has passed over the second operation portion 25, as shown in FIG. 6, the actuator 2A is urged by the spring 26 to be rotated up to the second output position in the direction of the arrow R, so as to cause the position of the acting portion 21 to be changed.

In the state where the protrusion 211 of the staple presser 210 has passed over the second operation portion 25 of the actuator 2A, the acting portion 21 of the actuator 2A presses the acted portion 502 of the transfer member 501 as shown in FIGS. 12 and 14. Therefore, the first detected portion 503 passes through the near end sensor 401 and the second detected portion 504 passes through the end sensor 402.

Since the first detected portion 503 passes through the near end sensor 401, the optical path of light receiving/emitting elements (not shown) of the near end sensor 401 is not blocked. Also, since the second detected portion 504 passes through the end sensor 402, the optical path of light receiving/emitting elements (not shown) of the end sensor 402 is not blocked.

In the stapler 301, it is determined that the amount of the staple sheets 101 accommodated in the refill 200 becomes the second predetermined amount i.e. the end state, based on a combination of outputs of the sensors in the state where the first detected portion 503 has passed through the near end sensor 401 and the second detected portion 504 has passed through the end sensor 402.

As described above, according to the cartridge 1A of the present embodiment, movement of the staple presser 210 due to reduction of the amount of the staple sheets 101 accommodated in the refill 200 is converted to movement of the actuator 2A, so that a position of the staple presser 210 changed by reduction of the amount of the staple sheets 101 is outputted as a position of the acting portion 21 of the actuator 2A.

As a result, the amount of the staple sheets 101 accommodated in the refill 200 can be outputted in such a mechanical manner. Therefore, the cartridge 1A can output that the amount of the staple sheets 101 in the refill 200 is in the near end state, and also this can be detected in the stapler 301.

<Exemplary Configuration of Image Formation System and Post-Processing Device>

Figure 15:
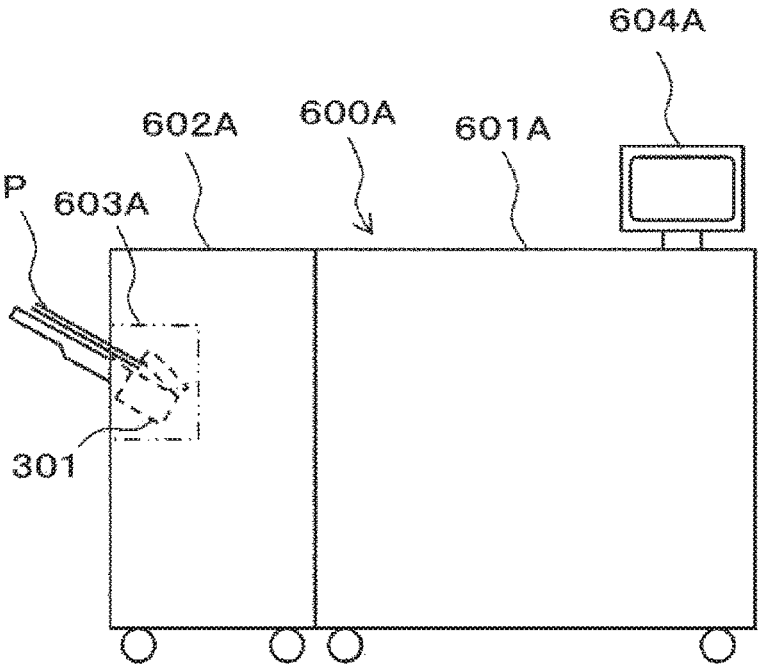
FIG. 15 is a configuration diagram showing an image formation system according to the present embodiment.

FIG. 15 is a configuration diagram showing an image formation system according to the present embodiment. The image formation system 600A of the present embodiment includes an image formation device 601A and a post-processing device 602A capable of performing at least one kind of processing. The image formation device 601A is configured to form an image on a sheet of paper P fed from a paper feeding unit (not shown), which is provided inside or outside the device, and then to output the sheet of paper P. In the present example, the image formation device 601A is configured to form an image on the sheet of paper P by forming an electrostatic latent image by scanning exposure, developing the electrostatic latent image with toner, and then transferring and fixing the toner onto the sheet of paper. The post-processing device 602A of the present embodiment includes the stapler 301 on a binding portion 603A thereof.

If it is detected in the stapler 301 that the amount of the staple sheets 101 is in the near end state, the post-processing device 602A outputs a near end detection signal. If the near end detection signal is inputted to the image formation system 600A, the image formation system 600A notifies that to a user.

Further, a remaining amount of the staple sheets 101 is compared with the number of times of binding sheets of paper P in the job of bookbinding operation, and then when the number of times of binding sheets of paper P in the job of bookbinding operation is large, a notice prompting to replace the cartridge 1A is issued. In this manner, the bookbinding operation can be prevented from being stopped due to exhaustion of staples sheets 101 during the bookbinding operation.

<Modified Examples of Cartridge of the Present Embodiment>

FIGS. 16 to 22 are broken side views showing modified examples of the cartridge according to the present embodiment. The same components as those of the cartridge 1A described in FIG. 1 and the like are designated by the same reference numerals, and accordingly, the descriptions thereof will be omitted.

Figure 16:
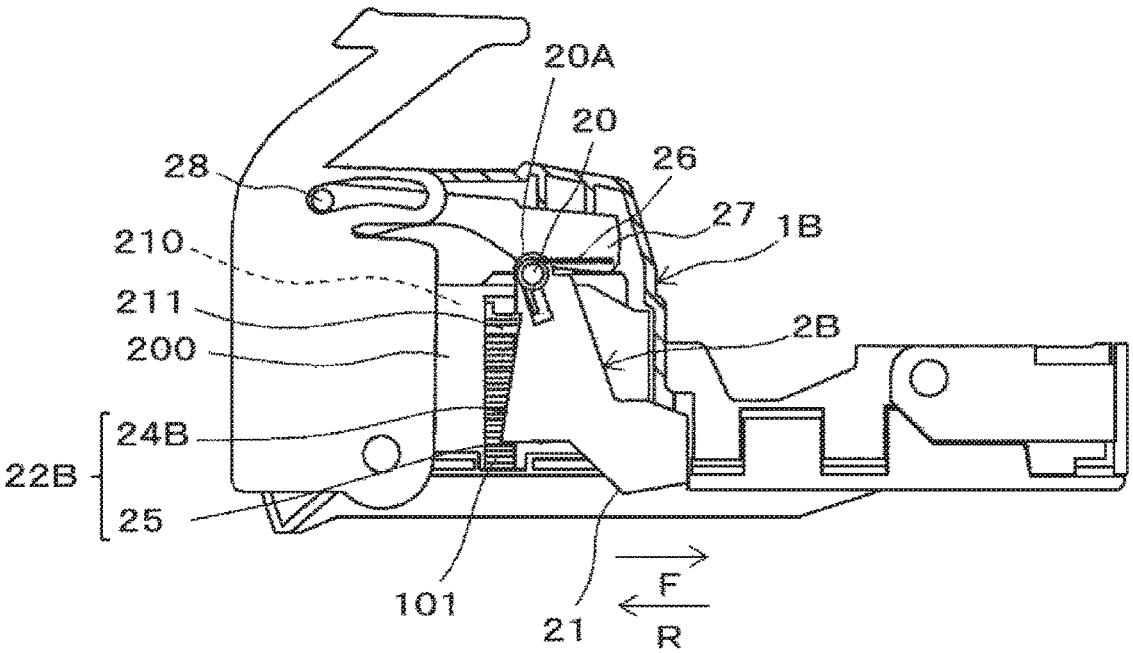
FIG. 16 is a broken side view showing a modified example of the cartridge according to the present embodiment.

A cartridge 1B as a staple cartridge shown in FIG. 16 includes an actuator 2B configured to operate in accordance with the amount of staple sheets 101 accommodated in a refill 200. The actuator 2B, which is an example of a displacement member, is provided at a location opposing a protrusion 211 of the refill 200 when the refill 200 is mounted on the cartridge 1B.

The actuator 2B is a plate-shaped member extending in a stacking direction of the staple sheets 101 and includes on a base end side thereof a support portion 20A supported on the cartridge 1B to be rotatable about a shaft 20. The actuator 2B includes an acting portion 21 on the other end side thereof.

The actuator 2B includes an abutting portion 22B configured to abut against the protrusion 211 of the refill 200. The abutting portion 22B is an example of an engaged portion and is configured by a surface, against which the protrusion 211 abuts. The abutting portion 22B is configured by an inclined surface intersecting with a moving path of the protrusion 211, i.e., with the stacking direction of the staple sheets 101. Specifically, the abutting portion 22B includes a first operation portion 24B and a second operation portion 25, which are configured to operate the actuator 2B in accordance with change in the amount of the staple sheets 101 accommodated in the refill 200. The first operation portion 24B is configured by providing an inclined surfaced inclined in a convex direction with respect to movement of the protrusion 211, so that the actuator 2B is linearly changed in accordance with the amount of the staple sheets 101. The second operation portion 25 is configured by providing a step on the abutting portion 22B. The inclined surface inclined in the convex direction is an example of a convex portion. The step on the abutting portion 22B constitutes a part of a step-shaped portion.

If the staple presser 210 is moved as the amount of the staple sheets 101 accommodated in the refill 200 is changed, a position, at which the protrusion 211 of the staple presser 210 and the abutting portion 22B of the actuator 2B abut against each other, is changed.

Therefore, if the staple presser 210 is moved as the amount of the staple sheets 101 accommodated in the refill 200 is reduced, the actuator 2B is pushed by the protrusion 211 while the protrusion 211 abuts against with the first operation portion 24B. Accordingly, the actuator 2B is rotated up to a position, at which the actuator 2B passes over the first output position, in a direction of an arrow F separating from the protrusion 211, so as to cause a position of the acting portion 21 to be changed.

If the protrusion 211 passes over the second operation portion 25 as the amount of the staple sheets 101 accommodated in the refill 200 is further reduced, the actuator 2B is urged by a spring 26 to be rotated up to the second output position in a direction of an arrow R approaching the protrusion 211, so as to cause a position of the acting portion 21 to be changed.

In this manner, movement of the staple presser 210 due to reduction of the amount of the staple sheets 101 accommodated in the refill 200 is converted to movement of the actuator 2B, so that a position of the staple presser 210 is outputted as a position of the acting portion 21.

Therefore, whether the staple sheets 101 accommodated in the refill 200 is in the near end state, the end state or the like can be outputted as a position of the acting portion 21 by movement of the actuator 2B.

Figure 17:
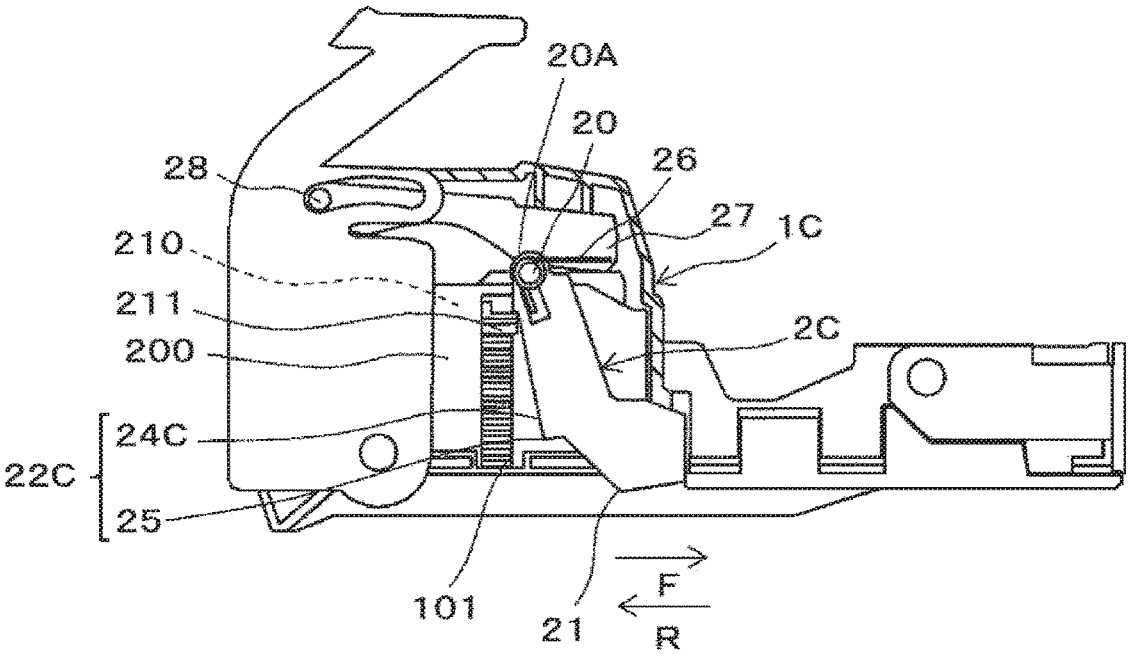
FIG. 17 is a broken side view showing a modified example of the cartridge according to the present embodiment.

A cartridge 1C as a staple cartridge shown in FIG. 17 includes an actuator 2C configured to operate in accordance with the amount of staple sheets 101 accommodated in a refill 200. The actuator 2C, which is an example of a displacement member, is provided at a location opposing a protrusion 211 of the refill 200 when the refill 200 is mounted on the cartridge 1C.

The actuator 2C is a plate-shaped member extending in a stacking direction of the staple sheets 101 and includes on a base end side thereof a support portion 20A supported on the cartridge 1C to be rotatable about a shaft 20. The actuator 2C includes an acting portion 21 on the other end side thereof, and the acting portion 21 is displaced by rotation of the actuator 2C about the shaft 20.

The actuator 2C includes an abutting portion 22C configured to abut against the protrusion 211 of the refill 200. The abutting portion 22C is an example of an engaged portion and is configured by a surface, against which the protrusion 211 abuts. The abutting portion 22C includes a first operation portion 24C and a second operation portion 25, which are configured to operate the actuator 2C in accordance with change in the amount of the staple sheets 101 accommodated in the refill 200. The first operation portion 24C is configured by providing an inclined surface inclined in a concave direction with respect to movement of the protrusion 211 in the stacking direction. The second operation portion 25 is configured by providing a step on the abutting portion 22C. The inclined surface inclined in the concave direction is an example of a concave portion. The step on the abutting portion 22C is an example of the concave portion and also constitutes a part of a step-shaped portion.

If the staple presser 210 is moved as the amount of the staple sheets 101 accommodated in the refill 200 is changed, a position, at which the protrusion 211 of the staple presser 210 and the abutting portion 22C of the actuator 2C abut against each other, is changed.

Therefore, if the staple presser 210 is moved as the amount of the staple sheets 101 accommodated in the refill 200 is reduced, the actuator 2C is urged by a spring 26 while the protrusion 211 abuts against with the first operation portion 24C. Accordingly, the actuator 2C is rotated up to a position, at which the actuator 2C passes over the first output position, in a direction of an arrow R approaching the protrusion 211, so as to cause a position of the acting portion 21 to be changed.

If the protrusion 211 passes over the second operation portion 25 as the amount of the staple sheets 101 accommodated in the refill 200 is further reduced, the actuator 2C is urged by the spring 26 to be rotated up to the second output position in a direction of the arrow R approaching the protrusion 211, so as to cause a position of the acting portion 21 to be changed.

In this manner, movement of the staple presser 210 due to reduction of the amount of the staple sheets 101 accommodated in the refill 200 is converted to movement of the actuator 2C, so that a position of the staple presser 210 is outputted as a position of the acting portion 21.

Therefore, whether the staple sheets 101 accommodated in the refill 200 is in the near end state or the end state can be outputted as a position of the acting portion 21 by movement of the actuator 2C.

Figure 18:
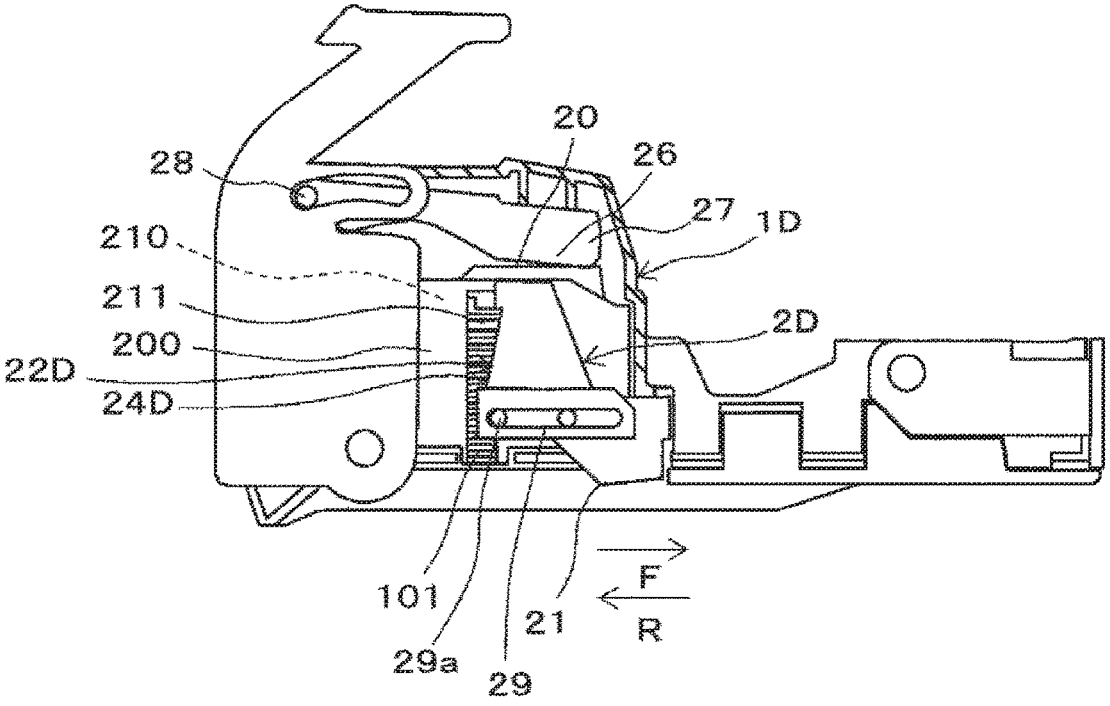
FIG. 18 is a broken side view showing a modified example of the cartridge according to the present embodiment.

A cartridge 1D as a staple cartridge shown in FIG. 18 includes an actuator 2D configured to operate in accordance with the amount of staple sheets 101 accommodated in a refill 200. The actuator 2D, which is an example of a displacement member, is provided at a location opposing a protrusion 211 of the refill 200 when the refill 200 is mounted on the cartridge 1D.

The actuator 2D has a configuration similar to that of the actuator 2B shown in FIG. 16 and includes an abutting portion 22D configured to be pushed by the protrusion 211 of the refill 200. The abutting portion 22D is an example of an engaged portion and is configured by a surface, against which the protrusion 211 abuts. The abutting portion 22D includes a first operation portion 24D and a second operation portion (not shown), which are configured to operate the actuator 2D in accordance with change in the amount of the staple sheets 101 accommodated in the refill 200. The first operation portion 24D is configured by providing an inclined surface inclined in a convex direction with respect to movement of the protrusion 211. The inclined surface inclined in the convex direction is an example of a convex portion.

The actuator 2B shown in FIG. 16 is configured such that the acting portion 21 is displaced by rotation thereof about the shaft 20. In contrast, the actuator 2D shown in FIG. 18 is configured such that the acting portion 21 is displaced as a pin 29*a* is guided and linearly moved by an elongated hole-shaped guide portion 29 provided in the cartridge 1D.

Figure 19:
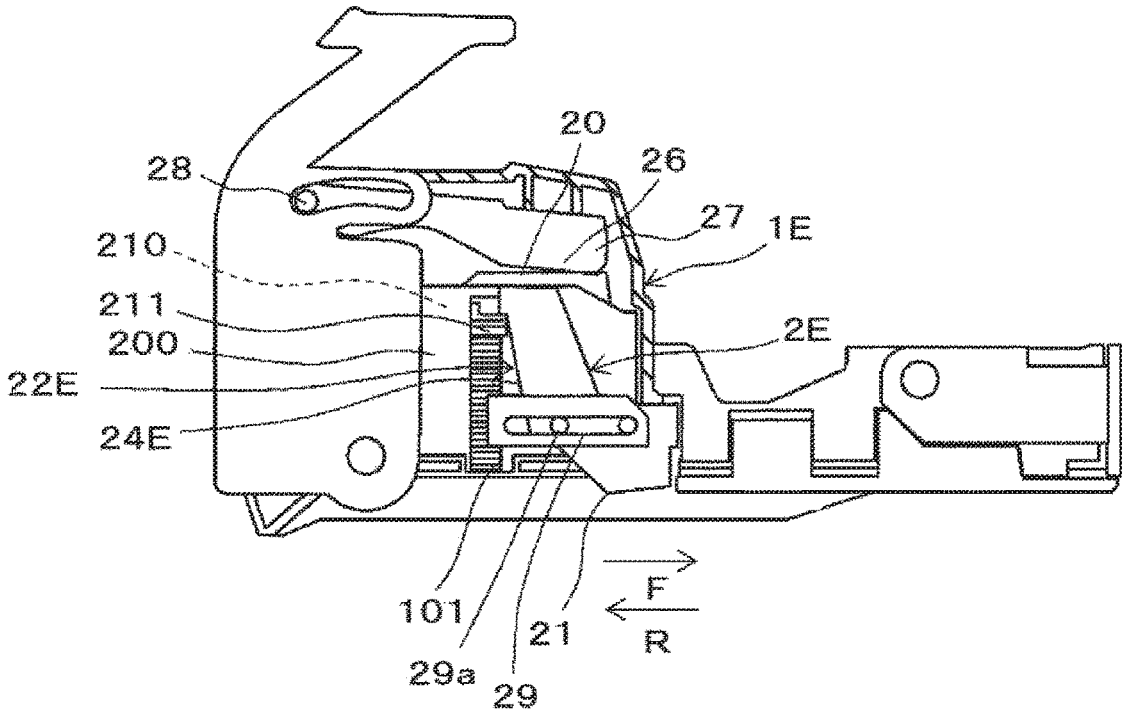
FIG. 19 is a broken side view showing a modified example of the cartridge according to the present embodiment.

A cartridge 1E as a staple cartridge shown in FIG. 19 includes an actuator 2E configured to operate in accordance with the amount of staple sheets 101 accommodated in a refill 200. The actuator 2E, which is an example of a displacement member, is provided at a location opposing a protrusion 211 of the refill 200 when the refill 200 is mounted on the cartridge 1E.

The actuator 2E has a configuration similar to that of the actuator 2C shown in FIG. 17 and includes an abutting portion 22E configured to be urged by the protrusion 211 of the refill 200. The abutting portion 22E is an example of an engaged portion and is configured by a surface, against which the protrusion 211 abuts. The abutting portion 22E includes a first operation portion 24E and a second operation portion (not shown), which are configured to operate the actuator 2E in accordance with change in the amount of the staple sheets 101 accommodated in the refill 200. The first operation portion 24E is configured by providing an inclined surface inclined in a concave direction with respect to movement of the protrusion 211. The inclined surface inclined in the concave direction is an example of a concave portion.

The actuator 2C shown in FIG. 17 is configured such that the acting portion 21 is displaced by rotation thereof about the shaft 20. In contrast, the actuator 2E shown in FIG. 19 is configured such that the acting portion 21 is displaced as a pin 29*a* is guided and linearly moved by an elongated hole-shaped guide portion 29 provided in the cartridge 1E.

Figure 20:
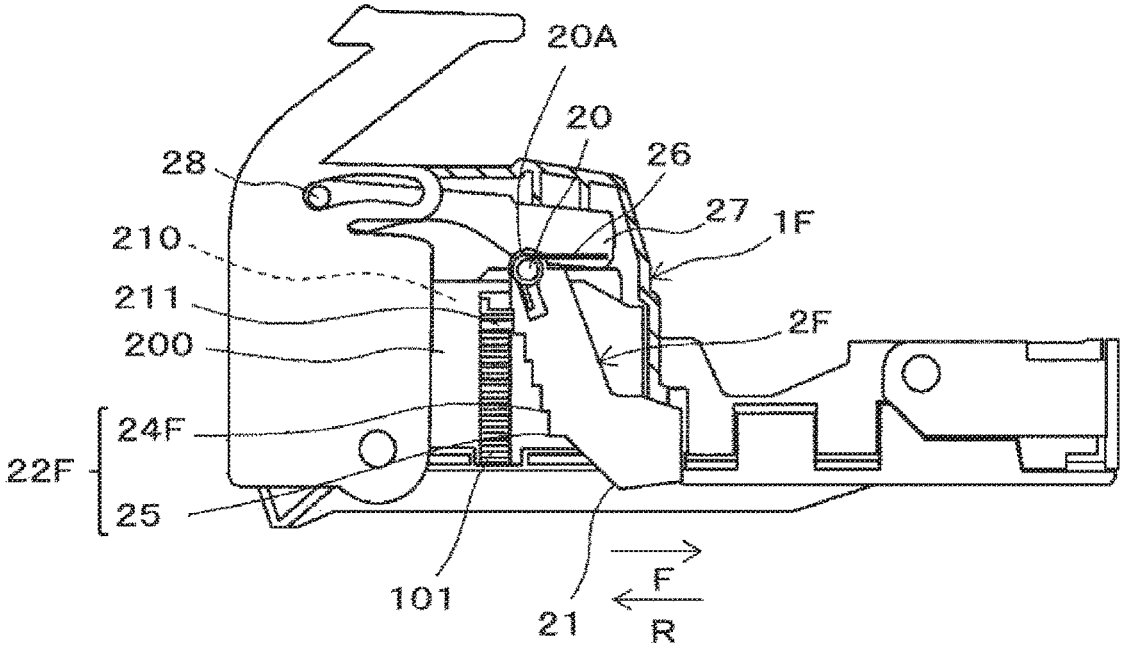
FIG. 20 is a broken side view showing a modified example of the cartridge according to the present embodiment.

A cartridge 1F as a staple cartridge shown in FIG. 20 includes an actuator 2F configured to operate in accordance with the amount of staple sheets 101 accommodated in a refill 200. The actuator 2F, which is an example of a displacement member, is provided at a location opposing a protrusion 211 of the refill 200 when the refill 200 is mounted on the cartridge 1F.

The actuator 2F is a plate-shaped member extending in a stacking direction of the staple sheets 101 and includes on a base end side thereof a support portion 20A supported on the cartridge 1F to be rotatable about a shaft 20. The actuator 2F includes an acting portion 21 on the other end side thereof.

The actuator 2F includes an abutting portion 22F arranged between the support portion 20A and the acting portion 21 and configured to abut against the protrusion 211 of the refill 200. The abutting portion 22F is an example of an engaged portion and is configured by a surface, against which the protrusion 211 abuts. The abutting portion 22F includes a step-shaped portion. The abutting portion 22F includes a first operation portion 24F and a second operation portion 25, which are configured to operate the actuator 2F in accordance with change in the amount of the staple sheets 101 accommodated in the refill 200. The first operation portion 24F is configured by providing a plurality of steps, which gradually become a concave shape, on the abutting portion 22F. The second operation portion 25 is configured by providing a step on the abutting portion 22F. The plurality of steps, which gradually become a concave shape, is an example of a concave portion. The plurality of steps is an example of a step-shaped portion. The step on the abutting portion 22F is an example of the concave portion and also constitutes a part of the step-shaped portion.

If the staple presser 210 is moved as the amount of the staple sheets 101 accommodated in the refill 200 is changed, a position, at which the protrusion 211 of the staple presser 210 and the abutting portion 22F of the actuator 2F abut against each other, is changed.

Therefore, if the staple presser 210 is moved as the amount of the staple sheets 101 accommodated in the refill 200 is reduced, the actuator 2F is urged and pushed by a spring 26 each time when the protrusion 211 passes over each steps of the first operation portion 24F. Accordingly, the actuator 2F is rotated up to a position, at which the actuator 2F passes over the first output position, in a direction of an arrow R approaching the protrusion 211, so as to cause a position of the acting portion 21 to be changed.

If the protrusion 211 passes over the second operation portion 25 as the amount of the staple sheets 101 accommodated in the refill 200 is further reduced, the actuator 2F is urged by the spring 26 to be rotated up to the second output position in a direction of the arrow R approaching the protrusion 211, so as to cause a position of the acting portion 21 to be changed.

In this manner, movement of the staple presser 210 due to reduction of the amount of the staple sheets 101 accommodated in the refill 200 is converted to movement of the actuator 2F, so that a position of the staple presser 210 is outputted as a position of the acting portion 21.

Therefore, whether the staple sheets 101 accommodated in the refill 200 is in the near end state or the end state can be outputted as a position of the acting portion 21 by movement of the actuator 2F. In addition, since the first operation portion 24F is configured by the plurality of steps, the actuator 2F can be operated in a stepwise manner, and also the numbers of points, at which the amount of the staple sheets 101 is detected, can be increased.

Figure 21:
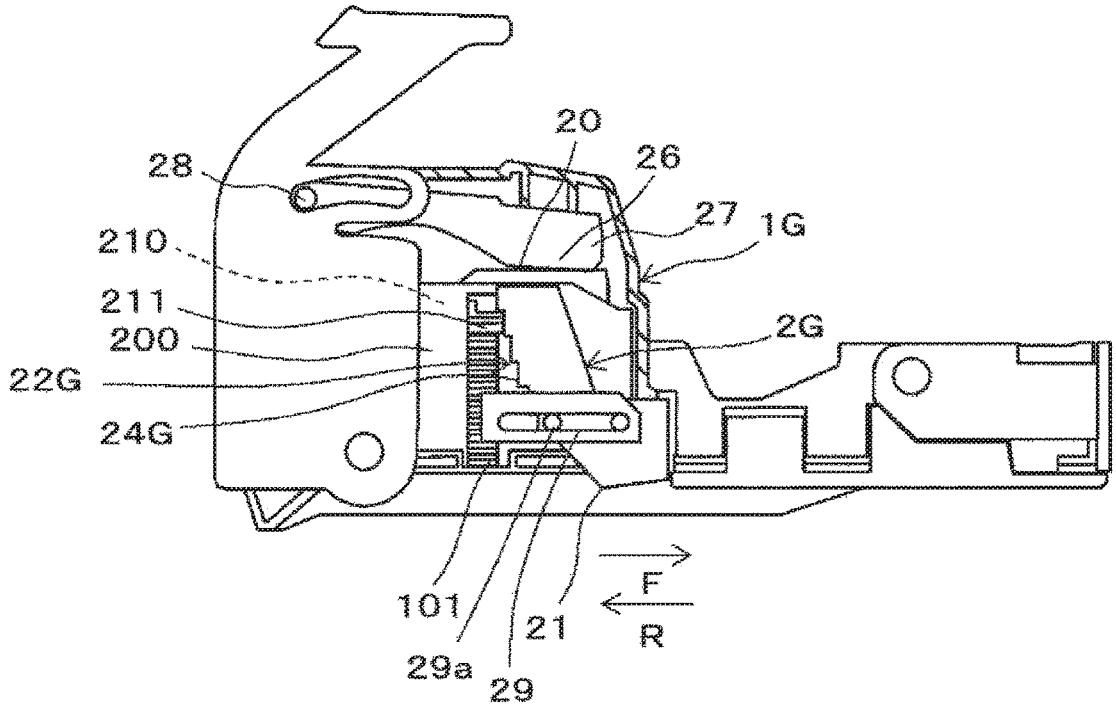
FIG. 21 is a broken side view showing a modified example of the cartridge according to the present embodiment.

A cartridge 1G as a staple cartridge shown in FIG. 21 includes an actuator 2G configured to operate in accordance with the amount of staple sheets 101 accommodated in a refill 200. The actuator 2G, which is an example of a displacement member, is provided at a location opposing a protrusion 211 of the refill 200 when the refill 200 is mounted on the cartridge 1G.

The actuator 2G has a configuration similar to that of the actuator 2F shown in FIG. 20 and includes an abutting portion 22G configured to be urged by the protrusion 211 of the refill 200. The abutting portion 22G is an example of an engaged portion and is configured by a surface, against which the protrusion 211 abuts. The abutting portion 22G includes a first operation portion 24G and a second operation portion (not shown), which are configured to operate the actuator 2G in accordance with change in the amount of the staple sheets 101 accommodated in the refill 200. The first operation portion 24G is configured by providing a plurality of steps, which gradually become a concave shape, on the abutting portion 22G. The plurality of steps, which gradually become a concave shape, is an example of a concave portion. Also, the plurality of steps is an example of a step-shaped portion.

The actuator 2F shown in FIG. 20 is configured such that the acting portion 21 is displaced by rotation thereof about the shaft 20. In contrast, the actuator 2G shown in FIG. 21 is configured such that the acting portion 21 is displaced as a pin 29*a* is guided and linearly moved by an elongated hole-shaped guide portion 29 provided in the cartridge 1G.

Figure 22:
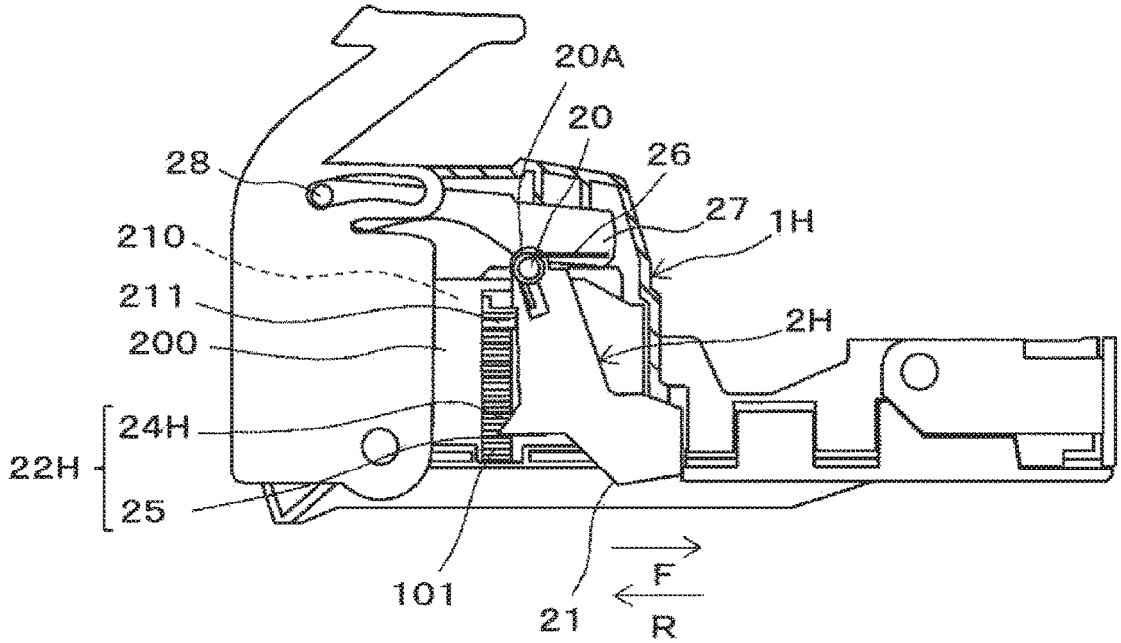
FIG. 22 is a broken side view showing a modified example of the cartridge according to the present embodiment.

A cartridge 1H as a staple cartridge shown in FIG. 22 includes an actuator 2H configured to operate in accordance with the amount of staple sheets 101 accommodated in a refill 200. The actuator 2H, which is an example of a displacement member, is provided at a location opposing a protrusion 211 of the refill 200 when the refill 200 is mounted on the cartridge 1H.

The actuator 2H is a plate-shaped member extending in a stacking direction of the staple sheets 101 and includes on a base end side thereof a support portion 20A supported on the cartridge 1H to be rotatable about a shaft 20. The actuator 2H includes an acting portion 21 on the other end side thereof.

The actuator 2H includes an abutting portion 22H configured to abut against the protrusion 211 of the refill 200. The abutting portion 22H is an example of an engaged portion and is configured by a surface, against which the protrusion 211 abuts. The abutting portion 22H includes a convex portion on a part thereof. The abutting portion 22H includes a first operation portion 24H and a second operation portion 25, which are configured to operate the actuator 2H in accordance with change in the amount of the staple sheets 101 accommodated in the refill 200. The first operation portion 24H is configured by providing an inclined surface inclined in a convex direction with respect to movement of the protrusion 211. The second operation portion 25 is configured by providing a step on the abutting portion 22H. The inclined surface inclined in the convex direction is an example of a convex portion. Further, the step on the abutting portion 22H is an example of the concave portion and also constitutes a part of a step-shaped portion.

If the staple presser 210 is moved as the amount of the staple sheets 101 accommodated in the refill 200 is changed, a position, at which the protrusion 211 of the staple presser 210 and the abutting portion 22H of the actuator 2H abut against each other, is changed.

Therefore, if the staple presser 210 is moved as the amount of the staple sheets 101 accommodated in the refill 200 is reduced, the actuator 2H is urged by the protrusion 211 while the protrusion 211 abuts against with the first operation portion 24H. Accordingly, the actuator 2H is rotated up to a position, at which the actuator 2H passes over the first output position, in a direction of an arrow F separating from the protrusion 211, so as to cause a position of the acting portion 21 to be changed.

If the protrusion 211 passes over the second operation portion 25 as the amount of the staple sheets 101 accommodated in the refill 200 is further reduced, the actuator 2H is urged by a spring 26 to be rotated up to the second output position in a direction of an arrow R approaching the protrusion 211, so as to cause a position of the acting portion 21 to be changed.

In this manner, movement of the staple presser 210 due to reduction of the amount of the staple sheets 101 accommodated in the refill 200 is converted to movement of the actuator 2H, so that a position of the staple presser 210 is outputted as a position of the acting portion 21.

Therefore, whether the staple sheets 101 accommodated in the refill 200 is in the near end state or the end state can be outputted as a position of the acting portion 21 by movement of the actuator 2H.

The invention claimed is:

1. A staple cartridge, on which a refill is configured to be mounted, the refill including: a refill main body configured to accommodate therein a plurality of staple sheets in a stacked state and having a discharging port for discharging the staple sheets; and a staple presser configured to be placed on the stacked staple sheets so as to move in a stacking direction of the staple sheets as the staple sheets are discharged through the discharging port and an amount of the staple sheets is reduced, the staple cartridge comprising:

a mount portion, on which the refill is configured be removably mounted; and a displacement member provided on the mount portion and configured to abut against the staple presser to be displaced in accordance with a position of the staple presser in a state where the refill is mounted on the mount portion, wherein the staple presser includes an engaging portion configured to be engaged in a receiving portion of the refill main body formed along the stacking direction, and the engaging portion is configured to be movable in the stacking direction as the engaging portion moves along the receiving portion, and wherein in the state where the refill is mounted, the displacement member is configured to abut against the engaging portion to be displaced in accordance with the position of the engaging portion.

2. The staple cartridge according to claim 1, wherein the displacement member includes an abutting portion configured to abut against the engaging portion, and wherein the abutting portion is configured to be urged toward the engaging portion by an elastic member and includes an inclined surface intersecting with a moving path of the engaging portion.

3. The staple cartridge according to claim 1, wherein the displacement member includes an abutting portion configured to abut against the engaging portion, and wherein the abutting portion is configured to be urged toward the engaging portion by an elastic member and includes a concave portion on a part thereof.

4. The staple cartridge according to claim 1, wherein the displacement member includes an abutting portion configured to abut against the engaging portion, and wherein the abutting portion is configured to be urged toward the engaging portion by an elastic member and includes a convex portion on a part thereof.

5. The staple cartridge according to claim 1, wherein the displacement member includes an abutting portion configured to abut against the engaging portion, and wherein the abutting portion is configured to be urged toward the engaging portion by an elastic member and includes a step-shaped portion.

6. A stapler, on which the staple cartridge according to claim 1 is configured to be removably mounted, the stapler comprising:

a detection unit configured to detect displacement of the displacement member.

7. A stapler on which a staple cartridge is configured to be removably mounted, in which a refill is configured to be mounted on the staple cartridge, the refill including: a refill main body configured to accommodate therein a plurality of staple sheets in a stacked state and having a discharging port for discharging the staple sheets; and a staple presser configured to be placed on the stacked staple sheets so as to move in a stacking direction of the staple sheets as the staple sheets are discharged through the discharging port and an amount of the staple sheets is reduced, the staple cartridge comprising:

a mount portion, on which the refill is configured be removably mounted; and a displacement member provided on the mount portion and configured to abut against the staple presser to be displaced in accordance with a position of the staple presser in a state where the refill is mounted on the mount portion, and wherein the stapler comprises a detection unit configured to detect displacement of the displacement member.

8. The stapler according to claim 7, wherein the staple presser includes an engaging portion configured to be engaged in a receiving portion of the refill main body formed along the stacking direction, and the engaging portion is configured to be movable in the stacking direction as the engaging portion moves along the receiving portion, and wherein in the state where the refill is mounted, the displacement member is configured to abut against the engaging portion to be displaced in accordance with the position of the engaging portion.

9. The stapler according to claim 8, wherein the displacement member includes an abutting portion configured to abut against the engaging portion, and wherein the abutting portion is configured to be urged toward the engaging portion by an elastic member and includes an inclined surface intersecting with a moving path of the engaging portion.

10. The stapler according to claim 8, wherein the displacement member includes an abutting portion configured to abut against the engaging portion, and wherein the abutting portion is configured to be urged toward the engaging portion by an elastic member and includes a concave portion on a part thereof.

11. The stapler according to claim 8, wherein the displacement member includes an abutting portion configured to abut against the engaging portion, and wherein the abutting portion is configured to be urged toward the engaging portion by an elastic member and includes a convex portion on a part thereof.

12. The stapler according to claim 8, wherein the displacement member includes an abutting portion configured to abut against the engaging portion, and wherein the abutting portion is configured to be urged toward the engaging portion by an elastic member and includes a step-shaped portion.

* * * * *